US008435098B2

(12) United States Patent
You

(10) Patent No.: US 8,435,098 B2
(45) Date of Patent: May 7, 2013

(54) ABRASIVE ARTICLE WITH CURED BACKSIZE LAYER

(75) Inventor: Xiaorong You, Shrewsbury, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 54 days.

(21) Appl. No.: 11/962,002

(22) Filed: Dec. 20, 2007

(65) Prior Publication Data

US 2008/0092455 A1 Apr. 24, 2008

Related U.S. Application Data

(63) Continuation-in-part of application No. 11/342,242, filed on Jan. 27, 2006, now Pat. No. 8,287, 611.

(60) Provisional application No. 60/871,373, filed on Dec. 21, 2006.

(51) Int. Cl.

| | |
|---|---|
| ***B24D 11/00*** | (2006.01) |
| ***B24D 1/00*** | (2006.01) |
| ***B24D 3/02*** | (2006.01) |
| ***C09C 1/68*** | (2006.01) |

(52) U.S. Cl.
USPC ..... 451/526; 51/295; 51/307

(58) Field of Classification Search ..... 451/526; 51/307–308, 295
See application file for complete search history.

(56) References Cited

U.S. PATENT DOCUMENTS

| | | | |
|---|---|---|---|
| 2,976,256 | A | 3/1961 | Whittier et al. |
| 3,708,296 | A | 1/1973 | Schlesinger |
| 4,250,053 | A | 2/1981 | Smith |
| 4,256,828 | A | 3/1981 | Smith |
| 4,457,766 | A | 7/1984 | Caul et al. |
| 4,751,102 | A | 6/1988 | Adair et al. |
| 4,772,530 | A | 9/1988 | Gottschalk et al. |
| 4,772,541 | A | 9/1988 | Gottschalk et al. |
| 4,853,434 | A | 8/1989 | Block |
| 5,002,856 | A | 3/1991 | Anderson |
| 5,059,701 | A | 10/1991 | Keipert |
| 5,108,463 | A | 4/1992 | Buchanan |
| 5,126,394 | A | 6/1992 | Revis et al. |
| 5,129,919 | A | 7/1992 | Kalinowski et al. |

(Continued)

FOREIGN PATENT DOCUMENTS

| | | | |
|---|---|---|---|
| EP | 0035969 | A1 | 9/1981 |
| EP | 0044274 | A2 | 1/1982 |

(Continued)

OTHER PUBLICATIONS

U.S. Appl. No. 60/648,168, filed Jan 28, 2005.*

(Continued)

*Primary Examiner* — Pegah Parvini
(74) *Attorney, Agent, or Firm* — Joseph P. Sullivan; Abel Law Group, LLP

(57) ABSTRACT

An abrasive article includes a backing having first and second major surfaces, an abrasive layer overlying the first major surface, and a backsize layer overlying the second major surface. The backsize layer is formed from a formulation including a cationically polymerizable component, a radically polymerizable component, and at least 5% by weight of a nano-sized filler based on the weight of the formulation.

20 Claims, 3 Drawing Sheets

U.S. PATENT DOCUMENTS

| | | | | |
|---|---|---|---|---|
| 5,137,542 | A | 8/1992 | Buchanan et al. | |
| 5,191,101 | A | 3/1993 | Palazzotto et al. | |
| 5,252,694 | A | 10/1993 | Willett et al. | |
| 5,328,716 | A | 7/1994 | Buchanan | |
| 5,342,419 | A | 8/1994 | Hibbard | |
| 5,417,726 | A | 5/1995 | Stout et al. | |
| 5,505,747 | A | 4/1996 | Chesley et al. | |
| 5,556,437 | A | 9/1996 | Lee et al. | |
| 5,560,753 | A | 10/1996 | Schnabel et al. | |
| 5,565,011 | A | 10/1996 | Follett et al. | |
| 5,573,619 | A | 11/1996 | Benedict et al. | |
| 5,573,816 | A | 11/1996 | Gaeta et al. | |
| 5,700,302 | A | 12/1997 | Stoetzel et al. | |
| RE35,709 | E * | 1/1998 | Culler | 51/308 |
| 5,833,724 | A | 11/1998 | Wei et al. | |
| 5,863,306 | A | 1/1999 | Wei et al. | |
| 5,868,806 | A | 2/1999 | Nishio et al. | |
| 6,120,878 | A | 9/2000 | Follensbee et al. | |
| 6,165,061 | A | 12/2000 | Fujii et al. | |
| 6,258,138 | B1 | 7/2001 | DeVoe et al. | |
| 6,293,980 | B2 | 9/2001 | Wei et al. | |
| 6,398,826 | B1 | 6/2002 | Fujii et al. | |
| 6,410,127 | B1 | 6/2002 | Kamae et al. | |
| 6,432,549 | B1 | 8/2002 | Kronzer | |
| 6,467,897 | B1 | 10/2002 | Wu et al. | |
| 6,605,128 | B2 | 8/2003 | Larson et al. | |
| 6,613,113 | B2 | 9/2003 | Minick et al. | |
| 6,657,001 | B1 | 12/2003 | Anderson et al. | |
| 6,660,828 | B2 | 12/2003 | Thomas et al. | |
| 6,669,745 | B2 | 12/2003 | Prichard et al. | |
| 6,758,734 | B2 | 7/2004 | Braunschweig et al. | |
| 6,773,474 | B2 | 8/2004 | Koehnle et al. | |
| 6,797,023 | B2 | 9/2004 | Knapp et al. | |
| 6,905,772 | B2 | 6/2005 | Shoup et al. | |
| 6,929,539 | B2 | 8/2005 | Schutz et al. | |
| 7,022,801 | B2 | 4/2006 | Medsker | |
| 7,087,710 | B2 | 8/2006 | Medsker et al. | |
| 2,292,261 | A1 | 6/2008 | Albertson | |
| 7,497,885 | B2 | 3/2009 | Kollodge | |
| 7,591,865 | B2 | 9/2009 | Gaeta et al. | |
| 2002/0037683 | A1 | 3/2002 | Goers et al. | |
| 2003/0049995 | A1 | 3/2003 | Schutz et al. | |
| 2003/0109662 | A1 | 6/2003 | Medsker et al. | |
| 2003/0131937 | A1 | 7/2003 | Konarski | |
| 2003/0143938 | A1 | 7/2003 | Braunschweig et al. | |
| 2003/0176156 | A1 | 9/2003 | Braunschweig et al. | |
| 2003/0200701 | A1 | 10/2003 | Koehnle et al. | |
| 2004/0020133 | A1 * | 2/2004 | Paxton et al. | 51/307 |
| 2004/0029511 | A1 * | 2/2004 | Kincaid et al. | 451/526 |
| 2004/0048957 | A1 | 3/2004 | Medsker et al. | |
| 2004/0147029 | A1 | 7/2004 | Adam | |
| 2004/0152799 | A1 | 8/2004 | Miller et al. | |
| 2004/0242804 | A1 | 12/2004 | Medsker et al. | |
| 2005/0019574 | A1 | 1/2005 | McCrary | |
| 2005/0020190 | A1 | 1/2005 | Schutz et al. | |
| 2005/0025967 | A1 | 2/2005 | Lawton et al. | |
| 2005/0032469 | A1 | 2/2005 | Duescher | |
| 2005/0069714 | A1 | 3/2005 | Hart et al. | |
| 2005/0223649 | A1 * | 10/2005 | O'Gary et al. | 51/294 |
| 2005/0262773 | A1 | 12/2005 | Schutz et al. | |
| 2006/0148642 | A1 | 7/2006 | Ryu et al. | |
| 2006/0154082 | A1 | 7/2006 | Miller et al. | |
| 2006/0207187 | A1 * | 9/2006 | Gaeta et al. | 51/293 |
| 2006/0211563 | A1 | 9/2006 | Arbab et al. | |
| 2006/0234901 | A1 | 10/2006 | Scheuing et al. | |
| 2008/0306203 | A1 | 12/2008 | Adam et al. | |

FOREIGN PATENT DOCUMENTS

| | | | |
|---|---|---|---|
| EP | 0054509 | A2 | 6/1982 |
| EP | 0094914 | A2 | 11/1983 |
| EP | 0094915 | A2 | 11/1983 |
| EP | 0153904 | A2 | 9/1985 |
| EP | 0164314 | A2 | 12/1985 |
| EP | 0223587 | A1 | 5/1987 |
| EP | 0266513 | A2 | 5/1988 |
| EP | 0407834 | A2 | 1/1991 |
| EP | 0546831 | B1 | 6/1993 |
| EP | 1236765 | A1 | 9/2002 |
| EP | 1312655 | A2 | 5/2003 |
| EP | 1342742 | A1 | 9/2003 |
| EP | 1366112 | B1 | 7/2004 |
| EP | 1457509 | A1 | 9/2004 |
| EP | 1463775 | | 10/2004 |
| EP | 1487612 | B1 | 4/2006 |
| JP | 6-206167 | | 7/1994 |
| JP | 9-503811 | | 4/1997 |
| JP | 9-506557 | | 6/1997 |
| JP | 2001-521831 | | 11/2001 |
| WO | 95/11111 | | 4/1995 |
| WO | 95/16547 | | 6/1995 |
| WO | 9609141 | | 3/1996 |
| WO | 9828663 | A1 | 7/1998 |
| WO | 9851747 | A1 | 11/1998 |
| WO | 99/22912 | | 5/1999 |
| WO | 0037569 | A1 | 6/2000 |
| WO | 0109260 | A1 | 2/2001 |
| WO | 0234848 | A1 | 5/2002 |
| WO | 02083776 | A1 | 10/2002 |
| WO | 02092660 | A2 | 11/2002 |
| WO | 03055948 | A1 | 7/2003 |
| WO | 2004013231 | A2 | 2/2004 |
| WO | 2004067599 | A1 | 8/2004 |
| WO | 2004081076 | A1 | 9/2004 |
| WO | 2005005506 | A1 | 1/2005 |
| WO | 2005026229 | A1 | 3/2005 |
| WO | 2005035200 | A | 4/2005 |
| WO | 2005047358 | A1 | 5/2005 |
| WO | 2006043072 | A1 | 4/2006 |
| WO | 2006065411 | A1 | 6/2006 |
| WO | 2006069179 | A2 | 6/2006 |
| WO | 2006083688 | A1 | 8/2006 |
| WO | 2006091520 | A1 | 8/2006 |

OTHER PUBLICATIONS

Jim Husman; Nanomaterials at 3M, Coupling Nanotechnology to Business Opportunities' PennState Materials Day: Commercial Applications of Nanotechnology, Apr. 15, 2004, 30 pages.

"Standard Test Method for Viscosity by Ford Viscosity Cup"; Copyright by ASTM International; United States; pp. 1-4, 1994.

"Standard Test Method for Kinematic Viscosity of Transparent and Opaques Liquids (and the Calculation of Dynamic Viscosity)"; Copyright by ASTM International; United States; pp. 1-10, 1997.

Stephan Sprenger, et al.; "Nano-modified Ambient Temperature Curing Epoxy Adhesives"; Special Issue of adhasion Kleben & Dichten; Mar. 2004; 5 pgs.

"Excellent Impregnation and Reduced Shrinkage"; hanse-chemie.com; pp. 1-3, Dec. 2004.

"CAB-O-SIL® Untreated Fumed Silica Properties & Functions," Brochure, 10 pages.

* cited by examiner

ABRASIVE ARTICLE WITH CURED BACKSIZE LAYER

CROSS-REFERENCE TO RELATED APPLICATION(S)

The present application is a continuation-in-part of U.S. patent application Ser. No. 11/342,242, filed Jan. 27, 2006 entitled "ABRASIVE ARTICLES AND METHODS FOR MAKING SAME," naming inventor Xiaorong You, Anthony C. Gaeta, and William C. Rice; and the present application claims priority from U.S. Provisional Application No. 60/871,373, filed Dec. 21, 2006, entitled "ABRASIVE ARTICLE WITH CURED BACKSIZE LAYER," naming inventor Xiaorong You, of which both applications are incorporated by reference herein in their entirety.

FIELD OF THE DISCLOSURE

This disclosure, in general, relates to abrasive articles that have cured backsize layers.

BACKGROUND

Abrasive articles, such as coated abrasives and bonded abrasives, are used in various industries to machine workpieces, such as by lapping, grinding, or polishing. Machining utilizing abrasive articles spans a wide industrial scope from optics industries, automotive paint repair industries, to metal fabrication industries. In each of these examples, manufacturing facilities use abrasives to remove bulk material or affect surface characteristics of products.

Surface characteristics include shine, texture, and uniformity. For example, manufacturers of metal components use abrasive articles to fine and polish surfaces, and oftentimes desire a uniformly smooth surface. Similarly, optics manufacturers desire abrasive articles that produce defect free surfaces to prevent light diffraction and scattering.

Manufactures also desire abrasive articles that have a high stock removal rate for certain applications. However, there is often a trade-off between removal rate and surface quality. Finer grain abrasive articles typically produce smoother surfaces, yet have lower stock removal rates. Lower stock removal rates lead to slower production and increased cost.

Particularly in the context of coated abrasive articles, manufactures of abrasive articles have introduced surface structures to improve stock removal rate, while maintaining surface quality. Coated abrasive articles having abrasive surface structures or patterns of raised abrasive layers, often called engineered or structured abrasives, typically exhibit improved useful life.

While the abrasive surfaces of the abrasive article generally influence stock removal rate and surface quality, a poor backing material can lead to degradation in other performance factors, such as machine wear and performance. For example, typical backing materials cause wear of mechanical components that secure the abrasive article. In particular, coated abrasive tapes and belts that advance through mechanical systems may wear shoes, back supports, and drums. Further, traditional backing materials may permit swarf and dislodged abrasive grains to become entrained between the backing and support components, causing wear.

To compensate for entrainment of swarf and grains, some manufacturers have turned to anti-static and hard surface coatings. However, such coatings often are difficult for a machine to secure, reducing machine performance. For example, such coated backings often lead to poor advancement of abrasive tape products through a machine or lead to bunching of tape in grind areas of the machine, each of which lead to down-time for repairs.

As such, an improved abrasive product including an improved backing material would be desirable.

SUMMARY

In a particular embodiment, an abrasive article includes a backing having first and second major surfaces, an abrasive layer overlying the first major surface, and a backsize layer overlying the second major surface. The backsize layer is formed from a formulation including a cationically polymerizable component, a radically polymerizable component, and at least 5% by weight of a nano-sized filler based on the weight of the formulation.

In another exemplary embodiment, an abrasive article includes a backing having first and second major surfaces, an abrasive layer overlying the first major surface, and a backsize layer overlying the second major surface. The backsize layer is formed from a solution formed nanocomposite polymer precursor.

In a further exemplary embodiment, a method of forming an abrasive article includes coating a first major surface of a backing with a binder formulation, coating a second major surface of the backing with a backsize formulation, and curing the binder formulation and the backsize formulation. The backsize formulation includes a cationically polymerizable component, a radically polymerizable component, and at least 5% by weight of a nano-sized filler based on the weight of the backsize formulation.

In an additional embodiment, an abrasive article includes a backing having first and second major surfaces, an abrasive layer overlying the first major surface, and a backsize layer overlying the second major surface and having a set of protrusions extending normal to the second major surface. The backsize layer includes a formulation including a cationically polymerizable component, a radically polymerizable component, and at least 5% by weight of a nano-sized filler based on the weight of the formulation.

In another exemplary embodiment, a method of forming an abrasive article includes coating a first major surface of a backing with a binder formulation, coating a second major surface of the backing with a backsize formulation, and concurrently curing the binder formulation and the backsize formulation.

In a further exemplary embodiment, a method of forming an abrasive article includes coating a first major surface of a polymer film backing with a radiation polymerizable binder formulation, coating a second major surface of the backing with a radiation polymerizable backsize formulation, and concurrently irradiating the binder formulation and the backsize formulation.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DESCRIPTION OF THE DRAWINGS

In a particular embodiment, an abrasive article includes a backing having first and second major surfaces, an abrasive layer overlying the first major surface, and a backsize layer overlying the second major surface. The backsize layer is formed from a coating material including a cationically polymerizable component, a radically polymerizable component, and at least about 5.0% by weight of a nano-sized filler based on the weight of the coating material. In an example, the cationically polymerizable component includes an epoxy component and the radically polymerizable component includes an acrylic component. In a particular example, the nano-sized filler is a solution formed filler and may be included in suspension in one of the cationically polymerizable component or the radically polymerizable component.

In another exemplary embodiment, a method of forming an abrasive article includes coating one side of a backing with a binder formulation, coating a second side of the backing with a backsize formulation, and curing the binder and coating formulations. In an example, the backsize formulation includes a cationically polymerizable component, a radically polymerizable component, and at least about 5.0 wt % of a nano-sized filler base on the weight of the backsize formulation. In particular, the nano-sized filler may be a solution formed nano-sized filler suspended in at least one of the cationically polymerizable component or the radically polymerizable component.

Figure 1:
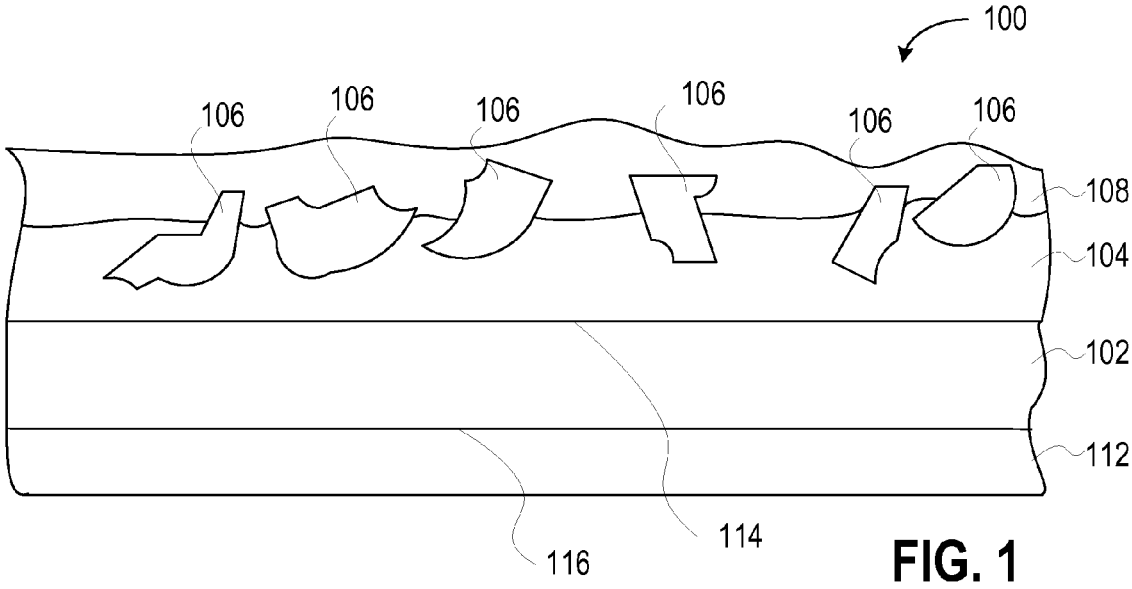
FIG. 1 includes an illustration of an exemplary coated abrasive article.

Coated abrasives generally include a layer of abrasive disposed over a backing or support. Particular coated abrasives include engineered or structured abrasives that generally include a pattern of abrasive structures disposed on the backing or support. An exemplary embodiment of a coated abrasive 100 is illustrated in FIG. 1. The coated abrasive includes a backing 102 and a layer 104 including abrasive grains 106 disposed over a first major surface 114 of the backing 102. In addition, the coated abrasive includes a backsize layer 112 disposed over a second major surface 116 of the backing 102. Further, the coated abrasive 100 may include a size coat 108 or a supersize coat (not shown).

The backing 102 may be flexible or rigid and may be made of any number of various materials including those conventionally used as backings in the manufacture of coated abrasives. An exemplary flexible backing includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, poly-cotton, or rayon); paper; vulcanized paper; vulcanized rubber; vulcanized fiber; nonwoven materials; any combination thereof; or any treated version thereof. Cloth backings may be woven or stitch bonded. In particular examples, the backing is selected from the group consisting of paper, polymer film, cloth, cotton, poly-cotton, rayon, polyester, poly-nylon, vulcanized rubber, vulcanized fiber, metal foil or any combination thereof. In other examples, the backing includes a thermoplastic film, such as a polypropylene film or a polyethylene terephthalate (PET) film.

An exemplary rigid backing includes a metal plate, a ceramic plate, or the like. Another example of a suitable rigid backing is described, for example, in U.S. Pat. No. 5,417,726 (Stout et al.), the disclosure of which is incorporated herein by reference.

Layer 104 may be formed as one or more coats. Generally, layer 104 is formed of a binder and binds abrasive grains 106 to overlie the first major surface 114 of the backing 112. In an exemplary embodiment, the abrasive grains 106 are blended with a binder formulation to form abrasive slurry. Alternatively, the abrasive grains 106 are applied over the binder formulation after the binder formulation is coated over the first major surface 114 of the backing 102. Optionally, a functional powder may be applied over layer 104 to prevent layer 104 from sticking to a patterning tooling. Alternatively, patterns may be formed in the layer 104 absent the functional powder.

The binder of the make coat (layer 104) or the size coat (layer 108) may be formed of a single polymer or a blend of polymers. Similarly, the coating material of the backsize layer 112 may be formed of a single polymer or a blend of polymers. For example, the binder or coating material may be formed from epoxy, acrylic polymer, or a combination thereof. In addition, the binder or coating material may include filler, such as nano-sized filler or a combination of nano-sized filler and micron-sized filler. In a particular embodiment, the binder or coating material includes a colloidal binder, wherein the formulation that is cured to form the binder or coating material is a colloidal suspension including particulate filler. Alternatively, or in addition, the binder or coating material may be a nanocomposite binder or coating material including sub-micron particulate filler.

The structured abrasive article 100 may optionally include a compliant coat (not shown) between the layer 104 and the backing 102. The compliant coat may be formed of binder or coating material formulations.

The binder generally includes a polymer matrix, which binds abrasive grains to the backing 102 or compliant coat, if present. Typically, the binder is formed of cured binder formulation. In one exemplary embodiment, the binder formulation includes a polymer component and a dispersed phase.

In addition, the coating material of the backsize layer 112 includes a polymer material formed from a cured backsize formulation. In an exemplary embodiment, the backsize formulation includes a polymer component and a dispersed phase.

Herein, the backsize formulation and the binder formulation are generally referred to as a coating formulation. While the generally described coating formulation may be used as one or both of the backsize and binder formulations, the backsize formulation and the binder formulation may be different, such as having different amounts of similar components. Alternatively, the backsize formulation and the binder formulation may be about the same, such as having the same composition.

The coating formulation may include one or more reaction constituents or polymer constituents for the preparation of a polymer. A polymer constituent may include a monomeric molecule, a polymeric molecule, or a combination thereof. The binder formulation or the backsize formulation may further include components selected from the group consisting of solvents, plasticizers, chain transfer agents, catalysts, stabilizers, dispersants, curing agents, reaction mediators, or agents for influencing the fluidity of the dispersion.

The polymer constituents can form thermoplastics or thermosets. By way of example, the polymer constituents may include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically polymerizable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The coating formulation may include a monomer, an oligomer, a polymer, or a combination thereof. In a particular embodiment, the coating formulation includes monomers of at least two types of polymers that when cured may crosslink. For example, the coating formulation may include epoxy constituents and acrylic constituents that when cured form an epoxy/acrylic polymer.

In an exemplary embodiment, the polymer reaction components include anionically or cationically polymerizable components. For example, the coating formulation may include at least one cationically polymerizable component, e.g., at least one cyclic ether component, cyclic lactone component, cyclic acetal component, cyclic thioether component, spiro orthoester component, epoxy-functional component, or oxetane-functional component. Typically, the coating formulation includes at least one component selected from the group consisting of an epoxy-functional component and an oxetane-functional component. The coating formulation may include, relative to the total weight of the coating formulation, at least about 10.0 wt % of a cationically polymerizable component, for example, at least about 20.0 wt %, typically, at least about 40.0 wt %, or at least about 50.0 wt % of the cationically polymerizable component. Generally, the coating formulation includes, relative to the total weight of the coating formulation, not greater than about 95.0 wt % of a cationically polymerizable component, for example, not greater than about 90.0 wt %, not greater than about 80.0 wt %, or not greater than about 70.0 wt % of the cationically polymerizable component. In general, the amounts of components are expressed as weight % of the component relative to the total weight of the coating formulation, unless explicitly stated otherwise.

The coating formulation may include at least one epoxy-functional component, e.g., an aromatic epoxy-functional component ("aromatic epoxy") or an aliphatic epoxy-functional component ("aliphatic epoxy"). Epoxy-functional components are components comprising one or more epoxy groups, i.e., one or more three-member ring structures (oxiranes).

Aromatic epoxies components include one or more epoxy groups and one or more aromatic rings. The coating formulation may include one or more aromatic epoxy components. An example of an aromatic epoxy component includes an aromatic epoxy derived from a polyphenol, e.g., from bisphenols, such as bisphenol A (4,4'-isopropylidenediphenol), bisphenol F (bis[4-hydroxyphenyl]methane), bisphenol S (4,4'-sulfonyldiphenol), 4,4'-cyclohexylidenebisphenol, 4,4'-biphenol, or 4,4'-(9-fluorenylidene)diphenol. The bisphenol may be alkoxylated (e.g., ethoxylated or propoxylated) or halogenated (e.g., brominated). Examples of bisphenol epoxies include bisphenol diglycidyl ethers, such as diglycidyl ether of Bisphenol A or Bisphenol F.

A further example of an aromatic epoxy includes triphenylolmethane triglycidyl ether, 1,1,1-tris(p-hydroxyphenyl) ethane triglycidyl ether, or an aromatic epoxy derived from a monophenol, e.g., from resorcinol (for example, resorcin diglycidyl ether) or hydroquinone (for example, hydroquinone diglycidyl ether). Another example is nonylphenyl glycidyl ether.

In addition, an example of an aromatic epoxy includes epoxy novolac, for example, phenol epoxy novolac and cresol epoxy novolac. A commercial example of a cresol epoxy novolac includes, for example, EPICLON N-660, N-665, N-667, N-670, N-673, N-680, N-690, or N-695, manufactured by Dainippon Ink and Chemicals, Inc. An example of a phenol epoxy novolac includes, for example, EPICLON N-740, N-770, N-775, or N-865, manufactured by Dainippon Ink and Chemicals Inc.

In one embodiment, the coating formulation may contain, relative to the total weight of the coating formulation, at least about 10.0 wt % of one or more aromatic epoxies.

Aliphatic epoxy components have one or more epoxy groups and are free of aromatic rings. The coating formulation may include one or more aliphatic epoxies. An example of an aliphatic epoxy includes glycidyl ether of C2-C30 alkyl; 1,2 epoxy of C3-C30 alkyl; mono or multi glycidyl ether of an aliphatic alcohol or polyol such as 1,4-butanediol, neopentyl glycol, cyclohexane dimethanol, dibromo neopentyl glycol, trimethylol propane, polytetramethylene oxide, polyethylene oxide, polypropylene oxide, glycerol, and alkoxylated aliphatic alcohols; polyols; or any combination thereof.

In one embodiment, the aliphatic epoxy includes one or more cycloaliphatic ring structures. For example, the aliphatic epoxy may have one or more cyclohexene oxide structures, for example, two cyclohexene oxide structures. An example of an aliphatic epoxy comprising a ring structure includes hydrogenated bisphenol A diglycidyl ether, hydrogenated bisphenol F diglycidyl ether, hydrogenated bisphenol S diglycidyl ether, bis(4-hydroxycyclohexyl)methane diglycidyl ether, 2,2-bis(4-hydroxycyclohexyl)propane diglycidyl ether, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate, di(3,4-epoxycyclohexylmethyl)hexanedioate, di(3,4-epoxy-6-methylcyclohexylmethyl)hexanedioate, ethylenebis(3,4-epoxycyclohexanecarboxylate), ethanedioldi(3,4-epoxycyclohexylmethyl)ether, 2-(3,4-epoxycyclohexyl-5,5-spiro-3,4-epoxy)cyclohexane-1,3-dioxane, or any combination thereof. An example of an aliphatic epoxy is also listed in U.S. Pat. No. 6,410,127, which is hereby incorporated in its entirety by reference.

In an embodiment, the coating formulation includes, relative to the total weight of the coating formulation, at least about 5.0 wt % of one or more aliphatic epoxies, for example, at least about 10.0 wt %, or at least about 20.0 wt % of the aliphatic epoxy. Generally, the coating formulation includes, relative to the total weight of the coating formulation, not greater than about 70.0 wt % of the aliphatic epoxy, for example, not greater than about 50.0 wt %, or even not greater than about 40.0 wt % of the aliphatic epoxy.

Typically, the coating formulation includes one or more mono or poly glycidylethers of aliphatic alcohols, aliphatic polyols, polyesterpolyols, polyetherpolyols, or any combination thereof. An example of such a component includes 1,4-butanedioldiglycidylether, glycidylether of polyoxyethylene or polyoxypropylene glycol or triol of molecular weight from about 200 to about 10,000; glycidylether of polytetramethylene glycol or poly(oxyethylene-oxybutylene) random or block copolymers. An example of commercially available glycidylether includes a polyfunctional glycidylether, such as Heloxy 48, Heloxy 67, Heloxy 68, Heloxy 107, and Grilonit F713; or monofunctional glycidylethers, such as Heloxy 71, Heloxy 505, Heloxy 7, Heloxy 8, or Heloxy 61 (sold by Resolution Performances, www.resins.com).

The coating formulation may contain about 3.0 wt % to about 40.0 wt %, more typically about 5.0 wt % to about 20.0 wt % of mono or poly glycidyl ether of an aliphatic alcohol, aliphatic polyols, polyesterpolyol or polyetherpolyol.

The coating formulation may include one or more oxetane-functional components ("oxetanes"). Oxetanes are components having one or more oxetane groups, i.e., one or more four-member ring structures including one oxygen and three carbon members.

Examples of oxetanes include components represented by the following formula:

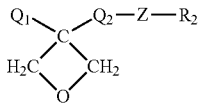

wherein

Q1 represents a hydrogen atom, an alkyl group having 1 to 6 carbon atoms (such as a methyl, ethyl, propyl, or butyl group), a fluoroalkyl group having 1 to 6 carbon atoms, an allyl group, an aryl group, a furyl group, or a thienyl group;

Q2 represents an alkylene group having 1 to 6 carbon atoms (such as a methylene, ethylene, propylene, or butylene group), or an alkylene group containing an ether linkage, for example, an oxyalkylene group, such as an oxyethylene, oxypropylene, or oxybutylene group Z represents an oxygen atom or a sulfur atom; and R2 represents a hydrogen atom, an alkyl group having 1-6 carbon atoms (e.g., a methyl group, ethyl group, propyl group, or butyl group), an alkenyl group having 2-6 carbon atoms (e.g., a 1-propenyl group, 2-propenyl group, 2-methyl-1-propenyl group, 2-methyl-2-propenyl group, 1-butenyl group, 2-butenyl group, or 3-butenyl group), an aryl group having 6-18 carbon atoms (e.g., a phenyl group, naphthyl group, anthranyl group, or phenanthryl group), a substituted or unsubstituted aralkyl group having 7-18 carbon atoms (e.g., a benzyl group, fluorobenzyl group, methoxy benzyl group, phenethyl group, styryl group, cynnamyl group, ethoxybenzyl group), an aryloxyalkyl group (e.g., a phenoxymethyl group or phenoxyethyl group), an alkylcarbonyl group having 2-6 carbon atoms (e.g., an ethylcarbonyl group, propylcarbonyl group, or butylcarbonyl group), an alkoxy carbonyl group having 2-6 carbon atoms (e.g., an ethoxycarbonyl group, propoxycarbonyl group, or butoxycarbonyl group), an N-alkylcarbamoyl group having 2-6 carbon atoms (e.g., an ethylcarbamoyl group, propylcarbamoyl group, butylcarbamoyl group, or pentylcarbamoyl group), or a polyether group having 2-1000 carbon atoms. One particularly useful oxetane includes 3-ethyl-3-(2-ethylhexyloxymethyl) oxetane.

In addition to or instead of one or more cationically polymerizable components, the coating formulation may include one or more free radical polymerizable components, e.g., one or more free radical polymerizable components having one or more ethylenically unsaturated groups, such as (meth)acrylate (i.e., acrylate or methacrylate) functional components.

An example of a monofunctional ethylenically unsaturated component includes acrylamide, N,N-dimethylacrylamide, (meth)acryloylmorpholine, 7-amino-3,7-dimethyloctyl (meth)acrylate, isobutoxymethyl(meth)acrylamide, isobornyloxyethyl(meth)acrylate, isobornyl(meth)acrylate, 2-ethylhexyl(meth)acrylate, ethyldiethylene glycol (meth) acrylate, t-octyl(meth)acrylamide, diacetone (meth)acrylamide, dimethylaminoethyl(meth)acrylate, diethylaminoethyl (meth)acrylate, lauryl (meth)acrylate, dicyclopentadiene (meth)acrylate, dicyclopentenyloxyethyl (meth)acrylate, dicyclopentenyl(meth)acrylate, N,N-dimethyl(meth)acrylamidetetrachlorophenyl (meth)acrylate, 2-tetrachlorophenoxyethyl (meth)acrylate, tetrahydrofurfuryl(meth)acrylate, tetrabromophenyl(meth)acrylate, 2-tetrabromophenoxyethyl (meth)acrylate, 2-trichlorophenoxyethyl(meth)acrylate, tribromophenyl(meth)acrylate, 2-tribromophenoxyethyl(meth) acrylate, 2-hydroxyethyl (meth)acrylate, 2-hydroxypropyl (meth)acrylate, vinylcaprolactam, N-vinylpyrrolidone, phenoxyethyl(meth)acrylate, butoxyethyl(meth)acrylate, pentachlorophenyl (meth)acrylate, pentabromophenyl(meth) acrylate, polyethylene glycol mono(meth)acrylate, polypropylene glycol mono(meth)acrylate, bornyl(meth)acrylate, methyltriethylene diglycol (meth)acrylate, or any combination thereof.

An example of the polyfunctional ethylenically unsaturated component includes ethylene glycol di(meth)acrylate, dicyclopentenyl di(meth)acrylate, triethylene glycol diacrylate, tetraethylene glycol di(meth)acrylate, tricyclodecanediyldimethylene di(meth)acrylate, trimethylolpropane tri(meth)acrylate, ethoxylated trimethylolpropane tri(meth) acrylate, propoxylated trimethylolpropane tri(meth)acrylate, tripropylene glycol di(meth)acrylate, neopentyl glycol di(meth)acrylate, both-terminal (meth)acrylic acid adduct of bisphenol A diglycidyl ether, 1,4-butanediol di(meth)acrylate, 1,6-hexanediol di(meth)acrylate, polyethylene glycol di(meth)acrylate, (meth)acrylate-functional pentaerythritol derivatives (e.g., pentaerythritol tri(meth)acrylate, pentaerythritol tetra(meth)acrylate, dipentaerythritol hexa(meth) acrylate, dipentaerythritol penta(meth)acrylate, or dipentaerythritol tetra(meth)acrylate), ditrimethylolpropane tetra (meth)acrylate, ethoxylated bisphenol A di(meth)acrylate, propoxylated bisphenol A di(meth)acrylate, ethoxylated hydrogenated bisphenol A di(meth)acrylate, propoxylated-modified hydrogenated bisphenol A di(meth)acrylate, ethoxylated bisphenol F di(meth)acrylate, or any combination thereof.

In an embodiment, the coating formulation comprises one or more components having at least 3 (meth)acrylate groups, for example, 3 to 6 (meth)acrylate groups, or 5 to 6 (meth) acrylate groups.

In particular embodiments, the coating formulation includes, relative to the total weight of the coating formulation, at least about 3.0 wt % of one or more free radical polymerizable components, for example, at least about 5.0 wt % or at least about 9.0 wt %. Generally, the coating formulation includes not greater than about 50.0 wt % of a free radical polymerizable component, for example, not greater than about 35.0 wt %, not greater than about 25.0 wt %, not greater than about 20.0 wt %, or even not greater than about 15.0 wt % of the free radical polymerizable component.

Generally, the polymer reaction constituents or precursors have on average at least two functional groups, such as on average at least 2.5 or at least 3.0 functional groups. For example, an epoxy precursor may have 2 or more epoxy-functional groups. In another example, an acrylic precursor may have two or more methacrylate functional groups.

It has surprisingly been found that a coating formulation including a component having a polyether backbone shows excellent mechanical properties after cure of the coating formulation. An example of a compound having a polyether backbone includes polytetramethylenediol, a glycidylether of polytetramethylenediol, an acrylate of polytetramethylenediol, a polytetramethylenediol containing one or more polycarbonate groups, or any combination thereof. In an embodiment, the coating formulation includes between 5.0 wt % and 20.0 wt % of a compound having a polyether backbone.

The coating formulation also may include a curing agent, such as a catalyst or a initiator. For example, the curing agent may include a cationic catalytic agent, such as a cationic initiator. In an example, a cationic initiator may catalyze reactions between cationic polymerizable components. In another example, the curing agent may include a radical initiator that may activate free-radical polymerization of radically polymerizable components. The initiator may be activated by thermal energy or actinic radiation. For example, an initiator may include a cationic photoinitiator that catalyzes cationic polymerization reactions when exposed to actinic radiation. In another example, the initiator may include a radical photoinitiator that initiates free-radical polymerization reactions when exposed to actinic radiation. Actinic radiation includes particulate or non-particulate radiation and is intended to include electron beam radiation and electromagnetic radiation. In a particular embodiment, electromagnetic radiation includes radiation having at least one wavelength in the range of about 100 nm to about 700 nm and, in particular, wavelengths in the ultraviolet range of the electromagnetic spectrum.

Generally, cationic photoinitiators are materials that form active species that, if exposed to actinic radiation, are capable of at least partially polymerizing epoxides or oxetanes. For example, a cationic photoinitiator may, upon exposure to actinic radiation, form cations that can initiate the reactions of cationically polymerizable components, such as epoxies or oxetanes.

An example of a cationic photoinitiator includes, for example, onium salt with anions of weak nucleophilicity. An example of a cationic photoinitiator may include a halonium salt, an iodosyl salt, or a sulfonium salt, such as described in published European patent application EP 153904 and WO 98/28663, a sulfoxonium salt, such as described, for example, in published European patent applications EP 35969, 44274, 54509, and 164314, or a diazonium salt, such as described, for example, in U.S. Pat. Nos. 3,708,296 and 5,002,856. All eight of these disclosures are hereby incorporated in their entirety by reference. Other examples of cationic photoinitiators include metallocene salt, such as described, for example, in published European applications EP 94914 and 94915, which applications are both hereby incorporated in their entirety by reference.

In exemplary embodiments, the coating formulation includes one or more photoinitiators represented by the following formula (1) or (2):

(1)

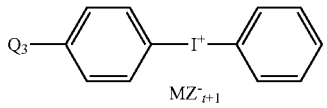

(2)

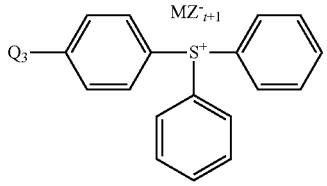

wherein

Q3 represents a hydrogen atom, an alkyl group having 1 to 18 carbon atoms, or an alkoxyl group having 1 to 18 carbon atoms; M represents a metal atom, e.g., antimony; Z represents a halogen atom, e.g., fluorine; and t is the valent number of the metal, e.g., 5 in the case of antimony.

In particular examples, the coating formulation may include, relative to the total weight of the coating formulation, about 0.1 wt % to about 15.0 wt % of one or more cationic photoinitiators, for example, about 1.0 wt % to about 10.0 wt % of the one or more cationic photoinitiators.

Typically, an onium salt photoinitiator includes an iodonium complex salt or a sulfonium complex salt. Useful aromatic onium complex salts are further described, for example, in U.S. Pat. No. 4,256,828 (Smith), the disclosure of which is incorporated herein by reference. An exemplary aromatic iodonium complex salt includes a diaryliodonium hexafluorophosphate or a diaryliodonium hexafluoroantimonate. An exemplary aromatic sulfonium complex salt includes a triphenylsulfonium hexafluoroantimonate p-phenyl(thiophenyl) diphenylsulfonium hexafluoroantimonate, or a sulfonium (thiodi-4,1-phenylene)bis(diphenyl-bis((OC-6-11)hexafluoroantimonate)).

Aromatic onium salts are typically photosensitive in the ultraviolet region of the spectrum. However, they can be sensitized to the near ultraviolet and the visible range of the spectrum by sensitizers for photolyzable organic halogen compounds. An exemplary sensitizer includes an aromatic amine or a colored aromatic polycyclic hydrocarbon, as described, for example, in U.S. Pat. No. 4,250,053 (Smith), the disclosure of which is incorporated herein by reference.

A suitable photoactivatable organometallic complex salt includes those described, for example, in U.S. Pat. Nos. 5,059,701 (Keipert); 5,191,101 (Palazzotto et al.); and 5,252,694 (Willett et al.), the disclosures of which are incorporated herein by reference. An exemplary organometallic complex salt useful as photoactivatable initiators includes ($\eta^6$-benzene)($\eta^5$-cyclopentadienyl)$Fe^{+1}$ $SbF_6^-$, ($\eta^6$-toluene)($\eta^5$-cyclopentadienyl)$Fe^{+1}$ $AsF_6^-$, ($\eta^6$-xylene)($\eta^5$-cyclopentadienyl)$Fe^{+1}$ $SbF_6^-$, ($\eta^6$-cumene)($\eta^5$-cyclopentadienyl)$Fe^{+1}$ $PF_6^-$, ($\eta^6$-xylenes (mixed isomers))($\eta^5$-cyclopentadienyl)-$Fe^{+1}$ $SbF_6^-$, ($\eta^6$-xylenes (mixed isomers))($\eta^5$-cyclopentadienyl)$Fe^{+1}$ $PF_6^-$, ($\eta^6$-o-xylene)($\eta^5$-cyclopentadienyl)$Fe^{+1}$ $CF_3$ $SO_3^-$, ($\eta^6$m-xylene)($\eta^5$-cyclopentadienyl)$Fe^{+1}$ $BF_4^-$, ($\eta^6$-mesitylene)($\eta^5$-cyclopentadienyl)$Fe^{+1}$ $SbF_6^-$, ($\eta^6$-hexamethylbenzene)($\eta^5$-cyclopentadienyl)$Fe^{+1}$ $SbF_5OH^-$, ($\eta^6$-fluorene)($\eta^5$-cyclopentadienyl)$Fe^{+1}$ $SbF_6^-$, or any combination thereof.

Optionally, organometallic salt catalysts can be accompanied by an accelerator, such as an oxalate ester of a tertiary alcohol. If present, the accelerator desirably comprises from about 0.1% to about 4.0% by weight of the total coating formulation.

A useful commercially available cationic photoinitiator includes an aromatic sulfonium complex salt, available, for example, under the trade designation "FX-512" from Minnesota Mining and Manufacturing Company, St. Paul, Minn., an aromatic sulfonium complex salt having the trade designation "UVI-6974", available from Dow Chemical Co., or Chivacure 1176.

The coating formulation may optionally include photoinitiators useful for photocuring free-radically polyfunctional acrylates. An example of a free radical photoinitiator includes benzophenone (e.g., benzophenone, alkyl-substituted benzophenone, or alkoxy-substituted benzophenone); benzoin (e.g., benzoin, benzoin ethers, such as benzoin methyl ether, benzoin ethyl ether, and benzoin isopropyl ether, benzoin phenyl ether, and benzoin acetate); acetophenone, such as acetophenone, 2,2-dimethoxyacetophenone, 4-(phenylthio) acetophenone, and 1,1-dichloroacetophenone; benzil ketal, such as benzil dimethyl ketal, and benzil diethyl ketal; anthraquinone, such as 2-methylanthraquinone, 2-ethylanthraquinone, 2-tertbutylanthraquinone, 1-chloroanthraquinone, and 2-amylanthraquinone; triphenylphosphine; benzoylphosphine oxides, such as, for example, 2,4,6-trimethylbenzoyldiphenylphosphine oxide; thioxanthone or xanthone; acridine derivative; phenazene derivative; quinoxaline derivative; 1-phenyl-1,2-propanedione-2-O-benzoyloxime; 1-aminophenyl ketone or 1-hydroxyphenyl ketone, such as 1-hydroxycyclohexyl phenyl ketone, phenyl (1-hydroxyisopropyl)ketone and 4-isopropylphenyl(1-hydroxyisopropyl) ketone; or a triazine compound, for example, 4'''-methyl thiophenyl-1-di(trichloromethyl)-3,5-S-triazine, S-triazine-2-(stilbene)-4,6-bistrichloromethyl, paramethoxy styryl triazine, or any combination thereof.

An exemplary photoinitiator includes benzoin or its derivative such as α-methylbenzoin; U-phenylbenzoin; α-allylbenzoin; α-benzylbenzoin; benzoin ethers such as benzil dimethyl ketal (available, for example, under the trade designation "IRGACURE 651" from Ciba Specialty Chemicals), benzoin methyl ether, benzoin ethyl ether, benzoin n-butyl ether; acetophenone or its derivative, such as 2-hydroxy-2-methyl-1-phenyl-1-propanone (available, for example, under the trade designation "DAROCUR 1173" from Ciba Specialty Chemicals) and 1-hydroxycyclohexyl phenyl ketone (available, for example, under the trade designation "IRGACURE 184" from Ciba Specialty Chemicals); 2-methyl-1-[4-(methylthio)phenyl]-2-(4-morpholinyl)-1-propanone (available, for example, under the trade designation "IRGACURE 907" from Ciba Specialty Chemicals); 2-benzyl-2-(dimethlamino)-1-[4-(4-morpholinyl)phenyl]-1-butanone (available, for example, under the trade designation "IRGACURE 369" from Ciba Specialty Chemicals); or any blend thereof.

Another useful photoinitiator includes pivaloin ethyl ether, anisoin ethyl ether; anthraquinones, such as anthraquinone, 2-ethylanthraquinone, 1-chloroanthraquinone, 1,4-dimethylanthraquinone, 1-methoxyanthraquinone, benzanthraquinonehalomethyltriazines, or the like; benzophenone or its derivative; iodonium salt or sulfonium salt as described hereinabove; a titanium complex such as bis(η5-2,4-cyclopentadienyl)bis[2,-6-difluoro-3-(1H-pyrrolyl)phenyl)titanium (commercially available under the trade designation "CGI784DC", also from Ciba Specialty Chemicals); a halomethylnitrobenzene such as 4-bromomethylnitrobenzene or the like; or mono-or bis-acylphosphine (available, for example, from Ciba Specialty Chemicals under the trade designations "IRGACURE 1700", "IRGACURE 1800", "IRGACURE 1850", and "DAROCUR 4265"). A suitable photoinitiator may include a blend of the above mentioned species, such as α-hydroxy ketone/acrylphosphin oxide blend (available, for example, under the trade designation IRGACURE 2022 from Ciba Specialty Chemicals.)

A further suitable free radical photoinitiator includes an ionic dye-counter ion compound, which is capable of absorbing actinic rays and producing free radicals, which can initiate the polymerization of the acrylates. See, for example, published European Patent Application 223587, and U.S. Pat. Nos. 4,751,102, 4,772,530 and 4,772,541, all four of which are hereby incorporated in their entirety by reference.

A photoinitiator can be present in an amount not greater than about 20.0 wt %, for example, not greater than about 10.0 wt %, and typically not greater than about 5.0 wt %, based on the total weight of the coating formulation. For example, a photoinitiator may be present in an amount of 0.1 wt % to 20.0 wt %, such as 0.1 wt % to 5.0 wt %, or most typically 0.1 wt % to 2.0 wt %, based on the total weight of the coating formulation, although amounts outside of these ranges may also be useful. In one example, the photoinitiator is present in an amount at least about 0.1 wt %, such as at least about 1.0 wt %, or in an amount of about 1.0 wt % to about 10.0 wt %.

Optionally, a thermal curative may be included in the coating formulation. Such a thermal curative is generally thermally stable at temperatures at which mixing of the components takes place. Exemplary thermal curatives for epoxy resins and acrylates are described, for example, in U.S. Pat. No. 6,258,138 (DeVoe et al.), the disclosure of which is incorporated herein by reference. A thermal curative may be present in a binder precursor in any effective amount. Such amounts are typically in the range of about 0.01 wt % to about 5.0 wt %, desirably in the range from about 0.025 wt % to about 2.0 wt % by weight, based upon the weight of the coating formulation, although amounts outside of these ranges may also be useful.

The coating formulation may also include other components such as solvents, plasticizers, crosslinkers, chain transfer agents, stabilizers, dispersants, curing agents, reaction mediators and agents for influencing the fluidity of the dispersion. For example, the coating formulation can also include one or more chain transfer agents selected from the group consisting of polyol, polyamine, linear or branched polyglycol ether, polyester and polylactone.

In another example, the coating formulation may include additional components, such as a hydroxy-functional or an amine functional component or additive. Generally, the particular hydroxy-functional component is absent curable groups (such as, for example, acrylate-, epoxy-, or oxetane groups) and are not selected from the group consisting of photoinitiators.

The coating formulation may include one or more hydroxy-functional components. A hydroxy-functional component may be helpful in further tailoring mechanical properties of the coating formulation upon cure. A hydroxy-functional component include a monol (a hydroxy-functional component comprising one hydroxy group) or a polyol (a hydroxy-functional component comprising more than one hydroxy group).

A representative example of a hydroxy-functional component includes an alkanol, a monoalkyl ether of polyoxyalkyleneglycol, a monoalkyl ether of alkyleneglycol, alkylene and arylalkylene glycol, such as 1,2,4-butanetriol, 1,2,6-hexanetriol, 1,2,3-heptanetriol, 2,6-dimethyl-1,2,6-hexanetriol, (2R,3R)-(−)-2-benzyloxy-1,3,4-butanetriol, 1,2,3-hexanetriol, 1,2,3-butanetriol, 3-methyl-1,3,5-pentanetriol, 1,2,3-cyclohexanetriol, 1,3,5-cyclohexanetriol, 3,7,11,15-tetramethyl-1,2,3-hexadecanetriol, 2-hydroxymethyltetrahydropyran-3,4,5-triol, 2,2,4,4-tetramethyl-1,3-cyclobutanediol, 1,3-cyclopentanediol, trans-1,2-cyclooctanediol, 1,16-hexadecanediol, 3,6-dithia-1,8-octanediol, 2-butyne-1,4-diol, 1,2- or 1,3-propanediol, 1,2- or 1,4-butanediol, 1,5-pentanediol, 1,6-hexanediol, 1,7-heptanediol, 1,8-octanediol, 1,9-nonanediol, 1-phenyl-1,2-ethanediol, 1,2-cyclohexanediol, 1,5-decalindiol, 2,5-dimethyl-3-hexyne-2,5-diol, 2,2,4-trimethylpentane-1,3-diol, neopentylglycol, 2-ethyl-1,3-hexanediol, 2,7-dimethyl-3,5-octadiyne-2-7-diol, 2,3-butanediol, 1,4-cyclohexanedimethanol, polyoxyethylene or polyoxypropylene glycols or triols of molecular weights from about 200 to about 10,000, polytetramethylene glycols of varying molecular weight, poly(oxyethylene-oxybutylene) random or block copolymers, copolymers containing pendant hydroxy groups formed by hydrolysis or partial hydrolysis of vinyl acetate copolymers, polyvinylacetal resins containing pendant hydroxyl groups, hydroxy-functional (e.g., hydroxy-terminated) polyesters or hydroxy-functional (e.g., hydroxy-terminated) polylactones, aliphatic polycarbonate polyols (e.g., an aliphatic polycarbonate diol), hydroxy-functional (e.g., hydroxy-terminated) polyethers (e.g., polytetrahydrofuran polyols having a number average molecular weight in the range of 150-4000 g/mol, 150-1500 g/mol, or 150-750 g/mol), or any combination thereof. An exemplary polyol further includes aliphatic polyol, such as glycerol, trimethylolpropane, or also sugar alcohol, such as erythritol, xylitol, mannitol or sorbitol. In particular embodiments, the coating formulation includes one or more alicyclic polyols, such as 1,4-cyclohexane-dimethanol, sucrose, or 4,8-bis(hydroxymethyl)tricyclo(5,2,1,0)decane.

A suitable polyether for the coating formulation includes, in particular, linear or branched polyglycol ether obtainable by ring-opening polymerization of cyclic ether in the presence of polyol, e.g., the aforementioned polyol; polyglycol ether, polyethylene glycol, polypropylene glycol or polytetramethylene glycol or a copolymer thereof.

Another suitable polyester for the coating formulation includes a polyester based on polyols and aliphatic, cycloaliphatic or aromatic polyfunctional carboxylic acids (for example, dicarboxylic acids), or specifically all corresponding saturated polyesters which are liquid at temperatures of 18° C. to 300° C., typically 18° C. to 150° C.: typically succinic ester, glutaric ester, adipic ester, citric ester, phthalic ester, isophthalic ester, terephthalic ester or an ester of corresponding hydrogenation products, with the alcohol component being composed of monomeric or polymeric polyols, for example, of those of the above-mentioned kind.

A further polyester includes aliphatic polylactone, such as ϵ-polycaprolactone, or polycarbonate, which, for example, are obtainable by polycondensation of diol with phosgene. For the coating formulation it is typical to use polycarbonate of bisphenol A having an average molecular weight of from 500 to 100,000.

For the purpose of influencing the viscosity of the coating formulation and, in particular, viscosity reduction or liquefaction, the polyol, polyether or saturated polyester or mixtures thereof, where appropriate, may be admixed with a further suitable auxiliary, particularly a solvent, a plasticizer, a diluent or the like. In an embodiment, the compositions may comprise, relative to the total weight of the coating formulation, not greater than about 15.0 wt %, such as not greater than about 10.0 wt %, not greater than about 6.0 wt %, not greater than about 4.0 wt %, not greater than about 2.0 wt %, or about 0.0 wt % of a hydroxy-functional component. In an example, the coating formulations are free of substantial amounts of a hydroxy-functional component. The absence of substantial amounts of hydroxy-functional components may decrease the hygroscopicity of the coating formulations or articles obtained therewith.

An example of a hydroxy or an amine functional organic compound for making condensation product with an alkylene oxide includes a polyol having 3 to 20 carbon atoms, a (C8-C18) fatty acid (C1-C8) alkanol amides like fatty acid ethanol amides, a fatty alcohol, an alkylphenol or a diamine having 2 to 5 carbon atoms. Such compounds are reacted with alkylene oxide, such as ethylene oxide, propylene oxide or any mixture thereof. The reaction may take place in a molar ratio of hydroxy or amine containing organic compound to alkyleneoxide of, for example, 1:2 to 1:65. The condensation product typically has a weight average molecular weight of about 500 to about 10,000, and may be branched, cyclic, linear, and either a homopolymer, a copolymer or a terpolymer.

The coating formulation further may include a dispersant for interacting with and modifying the surface of the particulate filler. For example, a dispersant may include organosiloxane, functionalized organisiloxane, alkyl-substituted pyrrolidone, polyoxyalkylene ether, ethyleneoxide propyleneoxide copolymer, or any combination thereof. For various particulate fillers and, in particular, for silica filler, a suitable surface modifier includes siloxane.

An example of siloxane includes functionalized or non-functionalized siloxane. An example of a siloxane includes a compound represented by the formula,

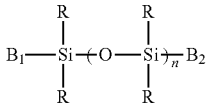

wherein each R is independently a substituted or unsubstituted linear, branched or cyclic C 1-10 alkyl, C 1-10 alkoxy, substituted or unsubstituted aryl, aryloxy, trihaloalkyl, cyanoalkyl or vinyl group; wherein B1 or B2 is a hydrogen, siloxy group, vinyl, silanol, alkoxy, amine, epoxy, hydroxy, (meth)acrylate, mercapto or solvent phobic groups such as lipophilic or hydrophilic (e.g., anionic, cationic) groups; and wherein n is an integer from about 1 to about 10,000, particularly from about 1 to about 100.

In general, the functionalized siloxane is a compound having a molecular weight ranging from about 300 to about 20,000. Such compounds are commercially available, for example, from the General Electric Company or from Goldschmidt, Inc. A typical functionalized siloxane is an amine functionalized siloxane wherein the functionalization is typically terminal to the siloxane.

Exemplary organosiloxanes are sold under the name Silwet by Witco Corporation. Such organosiloxanes typically have an average weight molecular weight of about 350 to about 15,000, are hydrogen or C1-C4 alkyl capped and may be hydrolyzable or non-hydrolyzable. Typical organosiloxanes include those sold under the name of Silwet L-77, L-7602, L-7604 and L-7605, which are polyalkylene oxide modified dialkyl polysiloxanes.

An example of a suitable anionic dispersant includes (C8-C16) alkylbenzene sulfonate, (C8-C16) alkane sulfonate, (C8-C18) α-olefin sulfonate, α-sulfo (C8-C16) fatty acid methyl ester, (C8-C16) fatty alcohol sulfate, mono- or dialkyl sulfosuccinate with each alkyl independently being a (C8-C16) alkyl group, alkyl ether sulfate, a (C8-C16) salt of carboxylic acid or isothionate having a fatty chain of about 8 to about 18 carbons, for example, sodium diethylhexyl sulfosuccinate, sodium methyl benzene sulfonate, or sodium bis (2-ethylhexyl)sulfosuccinate (for example, Aerosol OT or AOT).

Typical, the dispersant is a compound selected from an organosiloxane, a functionalized organosiloxane, an alkyl-substituted pyrrolidone, a polyoxyalkylene ether, or an ethyleneoxide propyleneoxide block copolymer.

An example of a commercial dispersant includes a cyclic organo-silicone (e.g., SF1204, SF1256, SF1328, SF1202 (decamethyl-cyclopentasiloxane(pentamer)), SF1258, SF1528, Dow Corning 245 fluids, Dow Corning 246 fluids, dodecamethyl-cyclo-hexasiloxane (heximer), or SF1173); a copolymer of a polydimethylsiloxane and a polyoxyalkylene oxide (e.g., SF1488 or SF1288); linear silicon comprising oligomers (e.g., Dow Corning 200 (R) fluids); Silwet L-7200, Silwet L-7600, Silwet L-7602, Silwet L-7605, Silwet L-7608, or Silwet L-7622; a nonionic surfactants (e.g., Triton X-100, Igepal CO-630, PVP series, Airvol 125, Airvol 305, Airvol 502, or Airvol 205); an organic polyether (e.g., Surfynol 420, Surfynol 440, or Surfynol 465); or Solsperse 41000.

Another exemplary commercial dispersant includes SF1173 (from GE Silicones); an organic polyether like Surfynol 420, Surfynol 440, or Surfynol 465 (from Air Products Inc); Silwet L-7200, Silwet L-7600, Silwet L-7602, Silwet L-7605, Silwet L-7608, or Silwet L-7622 (from Witco) or non-ionic surfactant such as Triton X-100 (from Dow Chemicals), Igepal CO-630 (from Rhodia), PVP series (from ISP Technologies), or Solsperse 41000 (from Avecia).

The amount of dispersant may range from 0.0 wt % to 5.0 wt %. More typically, the amount of dispersant is between 0.1 wt % and 2.0 wt %. The silanes are typically used in concentrations from 40.0 mol % to 200.0 mol % and, particularly, 60.0 mol % to 150.0 mol % relative to the molecular quantity surface active sites on the surface of a nano-sized particulate filler. Generally, the coating formulation includes not greater than about 5.0 wt % dispersant, such as about 0.1 wt % to about 5.0 wt % dispersant, based on the total weight of the coating formulation. Alternatively, the coating formulation may be free of dispersant.

The coating formulation may further include a dispersed phase suspended in an external phase. The external phase typically includes the polymer constituents. The dispersed phase generally includes particulate filler. The particulate filler may be formed of inorganic particles, such as particles, for example, of a metal (such as, for example, steel, silver, or gold) or a metal complex such as, for example, a metal oxide, a metal hydroxide, a metal sulfide, a metal halogen complex, a metal carbide, a metal phosphate, an inorganic salt (like, for example, $CaCO_3$), a ceramic, or any combination thereof. An example of a metal oxide is ZnO, CdO, $SiO_2$, $TiO_2$, $ZrO_2$, $CeO_2$, $SnO_2$, $MoO_3$, $WO_3$, $Al_2O_3$, $In_2O_3$, $La_2O_3$, $Fe_2O_3$, CuO, $Ta_2O_5$, $Sb_2O_3$, $Sb_2O_5$, or any combination thereof. A mixed oxide containing different metals may also be present. The nanoparticles may include, for example, particles selected from the group consisting of ZnO, $SiO_2$, $TiO_2$, $ZrO_2$, $SnO_2$, $Al_2O_3$, co-formed silica alumina, or any mixture thereof. The nanometer sized particles may also have an organic component, such as, for example, carbon black, a highly crosslinked/core shell polymer nanoparticle, an organically modified nanometer-size particle, etc. Such fillers are described in, for example, U.S. Pat. No. 6,467,897 and WO 98/51747, hereby incorporated by reference.

Particulate filler formed via solution-based processes, such as sol-formed and sol-gel formed ceramics, are particularly well suited for use in forming composite binder. Suitable sols are commercially available. For example, colloidal silicas in aqueous solutions are commercially available under such trade designations as "LUDOX" (E.I. DuPont de Nemours and Co., INC. Wilmington, Del.), "NYACOL" (Nyacol Co., Ashland, Ma.) and "NALCO" (Nalco Chemical Co., Oak Brook, Ill.). Many commercially available sols are basic, being stabilized by alkali, such as sodium hydroxide, potassium hydroxide, or ammonium hydroxide. Additional examples of suitable colloidal silicas are described in U.S. Pat. No. 5,126,394, incorporated herein by reference. Especially well suited are sol-formed silica and sol-formed alumina. The sols can be functionalized by reacting one or more appropriate surface-treatment agents with the inorganic oxide particles in the sol.

In a particular embodiment, the particulate filler is submicron sized. For example, the particulate filler may be a nano-sized particulate filler, such as a particulate filler having an average particle size of about 3 nm to about 500 nm. In an exemplary embodiment, the particulate filler has an average particle size about 3 nm to about 200 nm, such as about 3 nm to about 100 nm, about 3 nm to about 50 nm, about 8 nm to about 30 nm, or about 10 nm to about 25 nm. In particular embodiments, the average particle size is not greater than about 500 nm, such as not greater than about 200 nm, less than about 100 nm, or not greater than about 50 nm. For the particulate filler, the average particle size may be defined as the particle size corresponding to the peak volume fraction in a small-angle neutron scattering (SANS) distribution curve or the particle size corresponding to 0.5 cumulative volume fraction of the SANS distribution curve.

The particulate filler may also be characterized by a narrow distribution curve having a half-width not greater than about 2.0 times the average particle size. For example, the half-width may be not greater than about 1.5 or not greater than about 1.0. The half-width of the distribution is the width of the distribution curve at half its maximum height, such as half of the particle fraction at the distribution curve peak. In a particular embodiment, the particle size distribution curve is mono-modal. In an alternative embodiment, the particle size distribution is bi-modal or has more than one peak in the particle size distribution.

In a particular embodiment, the coating formulation may include at least two particulate fillers. Each of the particulate fillers may be formed of a material selected from the materials described above in relation to the particulate filler. The particulate fillers may be of the same material or of different materials. For example, each of the particulate fillers may be formed of silica. In an alternative example, one filler may be formed of silica and another filler may be formed of alumina. In an example, each of the particulate fillers has a particle size distribution having an average particle size not greater than about 1000 nm, such as not greater than about 500 nm, or less than about 100 nm. In another example, one of the particulate fillers has a particle size distribution having an average particle size not greater than about 1000 nm, such as not greater than about 500 nm, or less than about 100 nm, while a second particulate filler has an average particle size greater than about 1 micron, such as about 1 micron to about 10 microns, or about 1 micron to about 5 microns. Alternatively, the second particulate filler may have an average particle size as high as 1500 microns. In a particular embodiment, a coating formulation including a first particulate filler having a submicron average particle size and a second particulate filler having an average particle size greater than 1 micron advantageously provides improved mechanical properties when cured to form a binder.

Typically, the second particulate filler has a low aspect ratio. For example, the second particulate filler may have an aspect ratio not greater than about 2, such as about 1 or nearly spherical. Generally, the second particulate filler is untreated and not hardened through treatments. In contrast, abrasive grains typically are hardened particulates with an aspect ratio at least about 2 and sharp edges.

When selecting a second particulate filler, settling speed and viscosity are generally considered. As size increases, particulate fillers having a size greater than 1 micron tend to settle faster, yet exhibit less viscosity at higher loading. In addition, refractive index of the particulate filler may be considered. For example, a particulate filler may be selected with a refractive index at least about 1.35. Further, a particulate filler may be selected that does not include basic residue as basic residue may adversely influence polymerization of cationically polymerizing constituents.

The particulate filler is generally dispersed in a coating formulation. Prior to curing, the particulate filler is colloidally dispersed within the binder suspension and forms a colloidal composite binder once cured. For example, the particulate material may be dispersed such that Brownian motion sustains the particulate filler in suspension. In general, the particulate filler is substantially free of particulate agglomerates. For example, the particulate filler may be substantially mono-disperse such that the particulate filler is dispersed as single particles, and in particular examples, has only insignificant particulate agglomeration, if any.

In a particular embodiment, the particles of the particulate filler are substantially spherical. Alternatively, the particles may have a primary aspect ratio greater than 1, such as at least about 2, at least about 3, or at least about 6, wherein the primary aspect ratio is the ratio of the longest dimension to the smallest dimension orthogonal to the longest dimension. The particles may also be characterized by a secondary aspect ratio defined as the ratio of orthogonal dimensions in a plane generally perpendicular to the longest dimension. The particles may be needle-shaped, such as having a primary aspect ratio at least about 2 and a secondary aspect ratio not greater than about 2, such as about 1. Alternatively, the particles may be platelet-shaped, such as having a secondary aspect ratio at least about 2.

In an exemplary embodiment, the particulate filler is prepared in an aqueous solution and mixed with the coating formulation of the suspension. The process for preparing such suspension includes introducing an aqueous solution, such as an aqueous silica solution; polycondensing the silicate, such as to a particle size of 3 nm to 50 nm; adjusting the resulting silica sol to an alkaline pH; optionally concentrating the sol; mixing the sol with constituents of the external fluid phase of the suspension; and optionally removing water or other solvent constituents from the suspension. For example, an aqueous silicate solution is introduced, such as an alkali metal silicate solution (e.g., a sodium silicate or potassium silicate solution) with a concentration in the range between 20.0% and 50.0% by weight based on the weight of the solution. The silicate is polycondensed to a particle size of 3 nm to 50 nm, for example, by treating the alkali metal silicate solution with acidic ion exchangers. The resulting silica sol is adjusted to an alkaline pH (e.g., pH>8) to stabilize against further polycondensation or agglomeration of existing particles. Optionally, the sol can be concentrated, for example, by distillation, typically to $SiO_2$ concentration of about 30.0% to about 40.0% by weight. The sol is mixed with constituents of the external fluid phase. Thereafter, water or other solvent constituents are removed from the suspension. In a particular embodiment, the suspension is substantially water-free.

An exemplary embodiment of a polymeric constituent including solution formed nano-sized filler includes a filled epoxy constituent, such as Nanopox™, or filled acrylic constituent, such as Nanocryl™, each available from Hans Chemie.

The fraction of the external phase in the pre-cured coating formulation, generally including the organic polymeric constituents, as a proportion of the coating formulation may be about 20.0% to about 95.0% by weight, for example, about 30.0% to about 95.0% by weight, and typically from about 50.0% to about 95.0% by weight, and even more typically from about 55.0% to about 80.0% by weight. The fraction of the dispersed particulate filler phase can be about 5.0% to about 80.0% by weight, for example, about 5.0% to about 70.0% by weight, typically from about 5.0% to about 50.0% by weight, and more typically from about 20.0% to about 45.0% by weight. The colloidally dispersed and submicron particulate fillers described above are particularly useful in concentrations at least about 5.0 wt %, such as at least about 10.0 wt %, at least about 15.0 wt %, at least about 20.0 wt %, or as great as 40.0 wt % or higher. In contrast with traditional fillers, the solution formed nanocomposites exhibit low viscosity and improved processing characteristics at higher loading.

In a particular embodiment, the coating formulation includes about 10.0 wt % to about 90.0 wt % cationically polymerizable compound, not greater than about 40.0 wt % radically polymerizable compound, and about 5.0 wt % to about 80.0 wt % particulate filler, based on the total weight of the coating formulation. It is understood that the sum of the amounts of the coating formulation components adds to 100.0 wt % and, as such, when amounts of one or more components are specified, the amounts of other components correspond so that the sum of the amounts is not greater than 100.0 wt %.

The cationically polymerizable compound, for example, includes an epoxy-functional component or a oxetane-functional component. For example, the coating formulation may include about 10.0 wt % to about 60.0 wt % cationically polymerizable compound, such as about 20.0 wt % to about 50.0 wt % cationically polymerizable compound based on the weight of the coating formulation. In addition, the exemplary coating formulation may include not greater than about 20.0 wt %, such as about 5.0 wt % to about 20.0 wt % mono or poly glycidyl ethers of an aliphatic alcohol, aliphatic polyols, polyesterpolyol or polyetherpolyol. Further, the exemplary coating formulation may include not greater than about 50.0 wt %, such as about 5.0 wt % to about 50.0 wt % of a component having a polyether backbone, such as polytetramethylenediol, glycidylethers of polytetramethylenediol, acrylates of polytetramethylenediol or polytetramethylenediol containing one or more polycarbonate groups.

The radically polymerizable compound of the above example, for example, includes components having one or more methacylate groups, such as components having at least 3 methacrylate groups. In another example, the coating formulation includes not greater than about 30.0 wt %, such as not greater than about 20.0 wt %, not greater than about 10.0 wt % or not greater than about 5.0 wt % radically polymerizable compound.

The formulation may further include not greater than about 20.0 wt % cationic photoinitiator, such as about 0.1 wt % to about 20.0 wt %, or not greater than about 20.0 wt % radical photoinitiator, such as about 0.1 wt % to about 20.0 wt % radical photoinitiator. For example, the coating formulation may include not greater than about 10.0 wt %, such as not greater than about 5.0 wt % cationic photoinitiator. In another example, the coating formulation may include not greater than about 10.0 wt %, such as not greater than about 5.0 wt % free radical photoinitiator.

The particulate filler includes dispersed submicron particulates. Generally, the coating formulation includes 5.0 wt % to 80.0 wt %, such as 5.0 wt % to 60.0 wt %, for example, 5.0 wt % to 50.0 wt %, or 20.0 wt % to 45.0 wt % submicron particulate filler. Particular embodiments include at least about 5.0 wt % particulate filler, such as at least about 10.0 wt %, or at least about 20.0 wt %. In a particular embodiment, the particulate filler is solution formed silica particulate and may be colloidally dispersed in a polymer component. The exemplary coating formulation may further include not greater than about 5.0 wt % dispersant, such as 0.1 wt % to 5.0 wt % dispersant, selected from organosiloxanes, functionalised organosiloxanes, alkyl-substituted pyrrolidones, polyoxyalkylene ethers, or ethyleneoxide propyleneoxide block copolymer. Alternatively, the coating formulation may be free of dispersant.

In a particular embodiment, the coating formulation is formed by mixing a nanocomposite epoxy or acrylate precursor, i.e., a precursor including submicron particulate filler. For example, the coating formulation may include not greater than about 90.0 wt % nanocomposite epoxy and may include acrylic precursor, such as not greater than 50.0 wt % acrylic precursor. In another example, a nanocomposite acrylic precursor may be mixed with epoxy.

In a particular embodiment, the coating formulation when cured to form a coating material, such as a backsize coat, a make coat, or a size coat, may exhibit desirable mechanical properties. For example, the cured coating formulation may exhibit an elongation-at-break of at least about 1%. In addition, the cured coating formulation may have a tensile strength of at least about 20 MPa, such as at least about 30 MPa. Further, the cured coating formulation may have a elastic or Young's modulus of at least about 500 MPa, such as at least about 750 MPa.

The coating formulation including polymeric or monomeric constituents and including dispersed particulate filler may be used to form a make coat, a size coat, a compliant coat, or a back coat of a coated abrasive article. In an exemplary process for forming a make coat, the coating formulation is coated on a backing, abrasive grains are applied over the make coat, and the make coat is partially cured before patterning. A size coat may be applied over the make coat and abrasive grains. In another exemplary embodiment, the coating formulation is blended with the abrasive grains to form abrasive slurry that is coated on a backing, partially cured and patterned.

The abrasive grains may be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive grains may be selected from a group consisting of silica, alumina, zirconia, silicon carbide, silicon nitride, boron nitride, garnet, diamond, cofused alumina zirconia, ceria, titanium diboride, boron carbide, flint, emery, alumina nitride, or a blend thereof. In a further example, the abrasive grain may be formed of an agglomerated grain, such as an agglomerated grain described in U.S. Pat. No. 6,797,023, which is included herein by reference in its entirety. Particular embodiments have been created by use of dense abrasive grains comprised principally of alpha-alumina.

The abrasive grain may also have a particular shape. An example of such a shape includes a rod, a triangle, a pyramid, a cone, a solid sphere, a hollow sphere or the like. Alternatively, the abrasive grain may be randomly shaped.

The abrasive grains generally have an average grain size not greater than 2000 microns, such as not greater than about 1500 microns. In another example, the abrasive grain size is not greater than about 750 microns, such as not greater than about 350 microns. For example, the abrasive grain size may be at least 0.1 microns, such as from about 0.1 microns to about 1500 microns, and more typically from about 0.1 microns to about 200 microns, or from about 1 micron to about 100 microns. The grain size of the abrasive grains is typically specified to be the longest dimension of the abrasive grain. Generally, there is a range distribution of grain sizes. In some instances, the grain size distribution is tightly controlled.

In a blended abrasive slurry including the abrasive grains and the coating formulation, the abrasive grains provide from about 10.0% to about 90.0%, such as from about 30.0% to about 80.0%, of the weight of the abrasive slurry.

The abrasive slurry further may include a grinding aid to increase the grinding efficiency and cut rate. A useful grinding aid can be inorganic based, such as a halide salt, for example, sodium cryolite, and potassium tetrafluoroborate; or organic based, such as a chlorinated wax, for example, polyvinyl chloride. A particular embodiment of grinding aid includes cryolite and potassium tetrafluoroborate with particle size ranging from 1 micron to 80 microns, and most typically from 5 microns to 30 microns. The weight percent of grinding aid is generally not greater than about 50.0 wt %, such as from about 0.0 wt % to 50.0 wt %, and most typically from about 10.0 wt % to 30.0 wt % of the entire slurry (including the abrasive grains).

The coating formulation may be useful in forming a structured abrasive article. For example, the coating formulation may be coated on a backing, partially cured and patterned to form abrasive structures. In a particular embodiment, the structured abrasive article may be formed without the use of functional powder.

Figure 2:
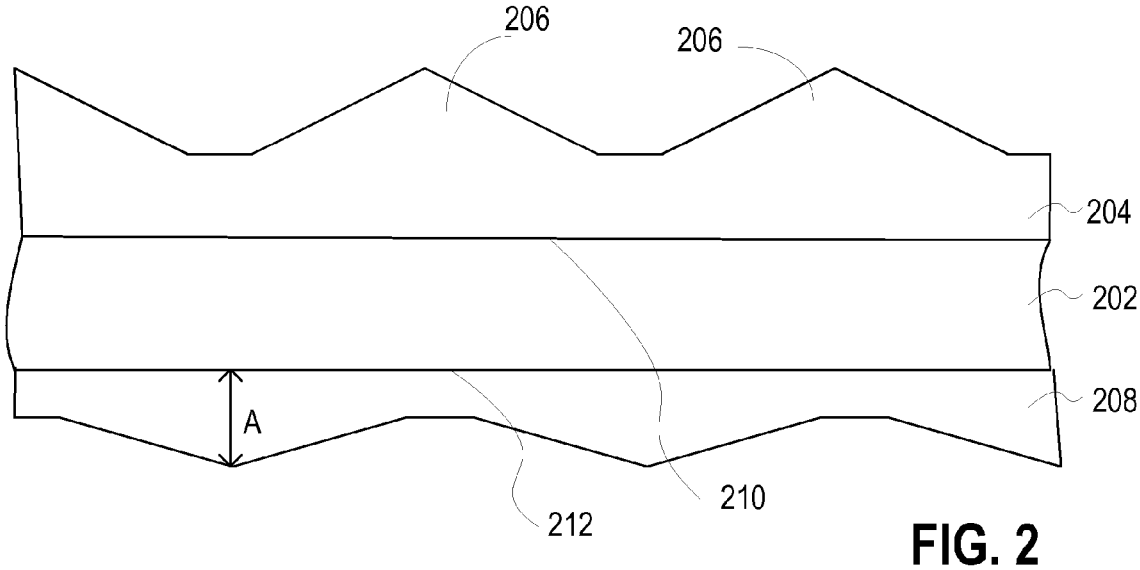
FIG. 2 includes an illustration of an exemplary structured abrasive article.

As illustrated in FIG. 1, the coating formulation may be used to form the make coat 104, the size coat 108, or the backsize layer 112. Optionally, the coated abrasive article 100 may be an engineered or structured abrasive article. As illustrated in FIG. 2, an abrasive layer 204 may be disposed over a first major surface 210 of a backing 202. The abrasive layer 204 may include a pattern of abrasive structures 206. Such a pattern, for example, may be embossed or stamped into an abrasive layer before curing or after partial curing of a binder formulation.

In addition, a pattern of protrusions may be formed in the backsize layer 208 disposed over a second surface 212 of the backing 202. For example, the pattern may be embossed or stamped into an abrasive layer before curing or after partial curing of a backsize formulation.

In particular, the protrusions may extend at least about 10 microns from the second major surface 212 of the backing 202 in a direction normal to the second major surface 212. For example, the protrusions may extend at least about 100 microns, such as at least about 500 microns, or even at least about 1 mm.

Figure 3:
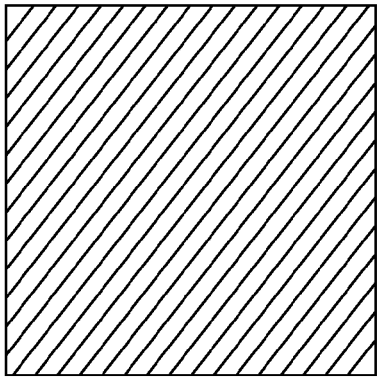
FIG. 3, FIG. 4, and FIG. 5 include illustrations of exemplary backsize layers.
Figure 4:
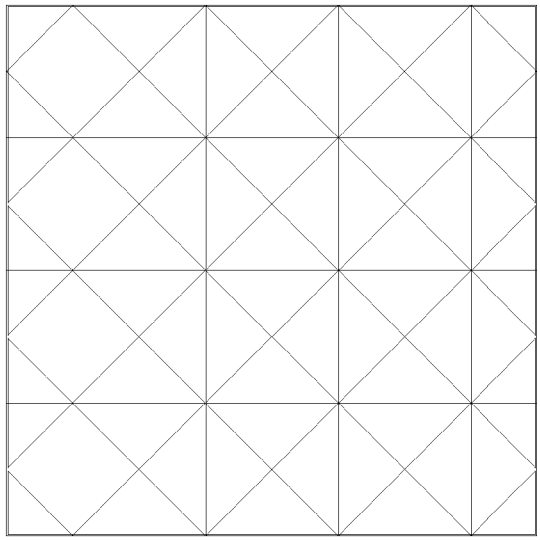
Figure 5:
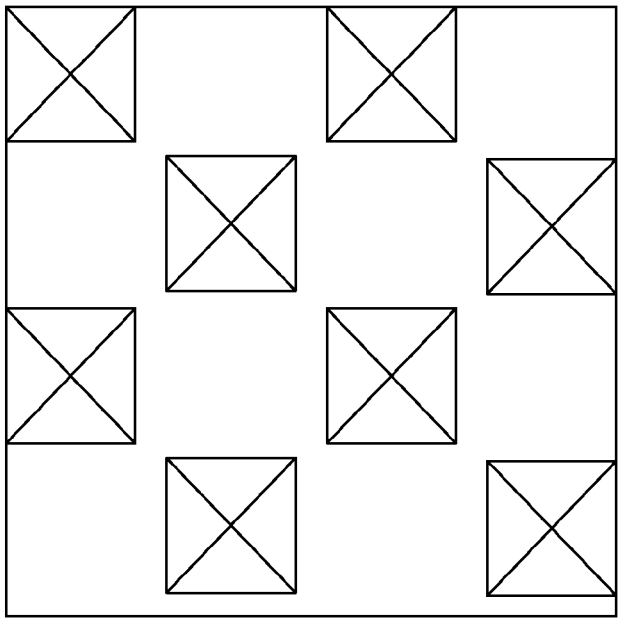

In an exemplary embodiment, the protrusions may have a shape, such as a ridge, a conical shape, a pyramidal shape, prism shape, a cubic shape, or any combination thereof. For example, FIG. 3 includes a top view illustration of prism shaped protrusions. Such prism shaped protrusions may be ordered in closely arranges rows with about 20 to about 80 rows per inch. Alternatively, the prism shaped protrusions may be uniformly distributed or even randomly placed with about 20 to about 80 rows per inch. In another example, the protrusions may include pyramidal shapes that are closely placed, as illustrated in FIG. 4. For example, the pyramidal shapes may be sized and arranged to include 10 to 60 pyramids per inch. In a further example, pyramidal shapes may be distributed, as illustrated in FIG. 5. A further exemplary pattern includes $25^{th}$ random trihelical, $50^{th}$ random trihelical, $25^{th}$ trihelical, $50^{th}$ trihelical, $75^{th}$ trihelical, $45^{th}$ pyramid, $16^{th}$ quad, or any combination thereof.

To form the abrasive article, the backsize formulation and binder formulations may be disposed over opposite surfaces of a backing. In an example, the formulations are disposed over the surfaces of the backing at different times and cured separately. Alternatively, the formulations are disposed over the surface of the backing concurrently and cured concurrently, such as simultaneously. When curing, the backsize and binder formulations may be may be completely cured or may be at least partially cured and cured to completion at a later time.

Figure 6:
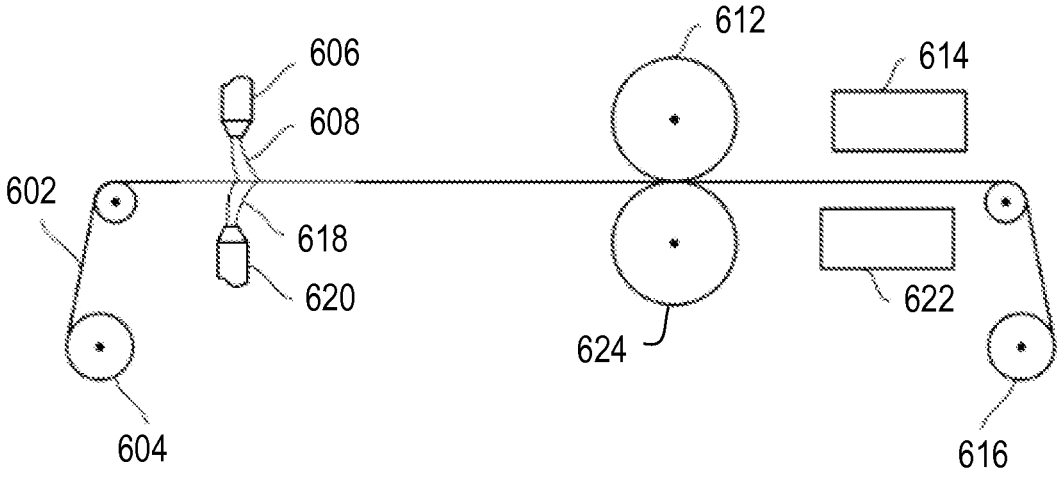
FIG. 6 includes an illustration of an exemplary device for forming an abrasive article.

FIG. 6 includes an illustration of an exemplary process. A backing 602 is paid from roll 604. The backing 602 is coated with a binder formulation 608 dispensed from a coating apparatus 606. In addition, the backing 602 is coated with a backsize formulation 618 dispensed from a coating apparatus 620. An exemplary coating apparatus includes a drop die coater, a knife coater, a curtain coater, a vacuum die coater or a die coater. Coating methodologies can include either contact or non-contact methods. For example, such methods include 2 roll, 3 roll reverse, knife over roll, slot die, gravure, extrusion or spray coating applications.

In a particular embodiment, the binder formulation 608 is provided in a slurry including the formulation and abrasive grains. In an alternative embodiment, the binder formulation 608 is dispensed separate from the abrasive grains. The abrasive grains may be provided following coating of the backing 602 with the binder formulation 608, after partial curing of the binder formulation 608, after patterning of the binder formulation 608, or after fully curing the binder formulation 608. The abrasive grains may, for example, be applied by a technique, such as electrostatic coating, drop coating or mechanical projection.

In an example, the backsize or binder formulations (608 or 618) may be patterned and cured. In a particular example, the backsize formulation 618 and the binder formulation 608 may be partially cured before patterning to increase the viscosity of the formulations (608 or 618) before patterning. Alternatively, the backsize and binder formulations (618 or 608) may have a viscosity prior to curing that permits pattern formation in the formulations (608 or 618) as dispensed.

Once the binder formulation 608 and the backsize formulation 618 have a desired viscosity, either as dispensed or after at least partial curing, a pattern of protrusions may be imparted to the formulations (608 or 618), such as through a rotogravure 612 or rotogravure 624. Alternatively, patterns may be formed in one or more of the formulations (608 or 618) through stamping or pressing. Typically, an embossing roll produces a desired surface structure with continuous web processes. An embossing roll is used in rotary coating lines and can be described as a nip roll arrangement wherein one roll is a backing roll and another is an "etched" or embossed roll. Compression of the coated web in this nip imparts the "positive" image of the embossed roll onto the web. Such embossing rolls often have recesses that distinguish them from standard gravure or anilox rolls used in the printing industry.

As illustrated in FIG. 6, patterns of protrusions may be imparted into the formulations 608 and 618 simultaneously. Alternatively, the patterns may be imparted to the formulations 608 and 618 separately.

Exemplary patterning tools may be heated. Typically, patterning forms a repeating pattern of raised structures. In a particular embodiment, the patterning is performed without functional powder. Alternatively, functional powder may be applied over the binder formulation 608 or the backsize formulation 618 prior to or after partial curing of the formulations 608 or 618 or prior to patterning.

In an example, the binder formulation 608 may be cured through an energy source 614 and the backing formulation 618 may be cured through an energy source 622. The selection of the energy source 614 or 622 depends in part upon the chemistry of the formulations 608 and 618. The energy sources 614 or 622 may be a source of thermal energy or actinic radiation energy, such as electron beam, ultraviolet light, or visible light. The amount of energy used depends on the chemical nature of the reactive groups in the precursor polymer constituents, as well as upon the thickness and density of the coating formulation 608 or 618. For thermal energy, an oven temperature of about 75° C. to about 150° C. and duration of about 5 minutes to about 60 minutes are generally sufficient. Electron beam radiation or ionizing radiation may be used at an energy level of about 0.1 MRad to about 100 MRad, particularly at an energy level of about 1 MRad to about 10 MRad. Ultraviolet radiation includes radiation having a wavelength within a range of about 200 nanometers to about 400 nanometers, particularly within a range of about 250 nanometers to 400 nanometers. Visible radiation includes radiation having a wavelength within a range of about 400 nanometers to about 800 nanometers, particularly in a range of about 400 nanometers to about 550 nanometers. Curing parameters, such as exposure, are generally formulation dependent and can be adjusted via lamp power and belt speed.

In an exemplary embodiment, the energy sources 614 and 622 provide actinic radiation to the coated backing, at least partially curing the coating formulation 608 or 618. In another embodiment, the coating formulations 608 or 618 are thermally curable and the energy sources 614 or 622 provide heat for thermal treatment. In a further embodiment, the coating formulations 608 or 618 may include actinic radiation curable and thermally curable components. As such, the coating formulation may be partially cured through one of thermal and actinic radiation curing and cured to complete curing through a second of thermal and actinic radiation curing. For example, an epoxy constituent of the coating formulation may be partially cured using ultraviolet electromagnetic radiation and an acrylic constituent of the coating formulation may be further cured through thermal curing.

Once the coating formulation is cured a structured abrasive article is formed. Alternatively, a size coat may be applied over the patterned abrasive structures. In an embodiment, a size coat may be applied over the binder formulation and abrasive grains. For example, the size coat may be applied before partially curing the binder formulation, after partially curing the binder formulation, after patterning the binder formulation, or after further curing the binder formulation. The size coat may be applied by, for example, roll coating or spray coating. Depending on the composition of the size coat and when it is applied, the size coat may be cured in conjunction with the binder formulation or cured separately. A supersize coat including grinding aids may be applied over the size coat and cured with the binder formulation, cured with the size coat or cured separately.

When the formulations 608 and 618 are partially cured, either prior to or after patterning, the patterned coating formulations 608 or 618 may be subsequently fully cured or cured to achieve desirable mechanical properties. The curing may be facilitated through an energy source or the coating formulation may be configured to cure over time. For example, the patterned coating formulation may be further cured by supply actinic radiation or thermal energy to the coating formulation depending on the curing mechanism of the coating formulation.

In a particular embodiment, the structured abrasive article is rolled into roll 616. In other embodiments, fully curing may be performed after rolling the partially cured abrasive article.

Particular embodiments of the above abrasive articles and method advantageously provide improved performance. Such embodiments advantageously reduce wear of abrading equipment. For example, when used in the form of an abrasive strip or tape, such embodiments reduce wear on drums, shoes, and back supports. Further, embodiments of such tapes more easily advance through abrading machines without bunching and with reduced wear.

EXAMPLES

Example Binder Formulations

Examples 1-6 illustrate exemplary backsize formulations including polymer constituents and nano-sized particulate filler.

Example 1

The exemplary backsize formulations include Nanopox XP 22/0314 available from Hanse Chemie, an epoxy resin including 3,4-epoxy cyclohexyl methyl-3,4-epoxy cyclohexyl carboxylate and 40 wt % colloidal silica particulate filler. The backsize formulations also include UVR 6105, which includes 3,4-epoxy cyclohexyl methyl-3,4-epoxy cyclohexyl carboxylate and no particulate filler. The backsize formulations further include a polyol (4,8-bis(hydroxymethyl)tricyclo(5.2.1.0)decane), a cationic photoinitiator (Chivacure 1176), a radical photoinitiator (Irgacure 2022, available from Ciba®), and acrylate precursor (SR 399, a dipentaerythritol pentaacrylate available from Atofina-Sartomer, Exton, Pa.). Table 1 illustrates the concentration of components in the backsize formulations.

TABLE 1

Example Backsize Formulations

| INGREDIENT | 1.1 Wt % | 1.2 Wt % | 1.3 Wt % | 1.4 Wt % | 1.5 Wt % |
|---|---|---|---|---|---|
| Nanopox XP 22/0314 | 0.00 | 20.00 | 40.00 | 60.00 | 79.92 |
| UVR 6105 | 79.92 | 59.92 | 39.92 | 19.92 | 0.00 |
| 4,8-bis(hydroxymethyl) tricyclo(5.2.1.0)decane | 13.50 | 13.50 | 13.50 | 13.50 | 13.50 |
| Irgacure 2022 | 0.48 | 0.48 | 0.48 | 0.48 | 0.48 |
| Chivacure 1176 | 1.50 | 1.50 | 1.50 | 1.50 | 1.50 |
| SR 399 | 4.60 | 4.60 | 4.60 | 4.60 | 4.60 |

Example 2

In another example, the backsize formulations include one polyol selected from the group consisting of Terathane 250, Terathane 1000, 4,8-bis(hydroxymethyl)tricyclo(5.2.1.0)decane, 2-ethyl-1,3-hexanediol, and 1,5-pentanediol. The selected polyol is mixed with Nanopox XP 22/0314, Irgacure 2022, Chivacure 1176, and Nanocryl XP 21/0940. Nanocryl XP 21/0940 is an acrylate precursor (tetraacrylate) including 50 wt % colloidal silica particulate filler, available from Hanse Chemie, Berlin. The concentrations are illustrated in TABLE 2.

TABLE 2

Example Backsize Formulations

| INGREDIENT | 2.1 Wt % | 2.2 Wt % | 2.3 Wt % | 2.4 Wt % | 2.5 Wt % |
|---|---|---|---|---|---|
| Nanopox XP 22/0314 | 74.46 | 74.46 | 74.46 | 74.46 | 74.46 |
| Irgacure 2022 | 0.48 | 0.48 | 0.48 | 0.48 | 0.48 |
| Chivacure 1176 | 1.50 | 1.50 | 1.50 | 1.50 | 1.50 |
| Nanocryl XP 21/0940 | 11.06 | 11.06 | 11.06 | 11.06 | 11.06 |
| Terathane 250 | 12.49 | | | | |
| Terathane 1000 | | 12.49 | | | |
| 4,8-bis(hydroxymethyl) tricyclo(5.2.1.0)decane | | | 12.49 | | |
| 2-ethyl-1,3-hexanediol | | | | 12.49 | |
| 1,5-pentanediol | | | | | 12.49 |
| EVALUATION | | | | | |
| Filler % | 35.32 | 35.32 | 35.32 | 35.32 | 35.32 |
| Tg (tan delta, ° C.) | 84.25 | 116.55 | 139.8 | 93.6 | 53.85 |
| E' at 23° C. (MPa) | 2374.5 | 2591.5 | 3258 | 2819.5 | 1992 |

The samples each exhibit a desirable glass transition temperature. In addition, the samples exhibit a desirable elastic or Young's modulus. For example, the samples exhibit an elastic modulus of at least about 1990 MPa, and particular samples exhibit an elastic modulus of at least about 2500 MPa, or even 3200 MPa.

Example 3

In this example, three acrylate resins (Nanocryl XP 21/0940 (tetraacrylate), Nanocryl XP 21/0930 (diacrylate), and Nanocryl 21/0954 (trimethylolpropan ethox triacrylate), each including 50 wt % colloidal silica particulate filler and each available from Hanse Chemie) are tested. The backsize formulations further include Nanopox XP 22/0314, 1,5-pentanediol, Irgacure 2022, and Chivacure 1176. The compositions are illustrated in Table 3.

TABLE 3

Example Backsize Formulations

| INGREDIENT | 3.4 Wt % | 3.5 Wt % | 3.6 Wt % |
|---|---|---|---|
| Nanopox XP 22/0314 | 77.28 | 77.28 | 77.28 |
| 1,5-pentanediol | 15.46 | 15.46 | 15.46 |
| Irgacure 2022 | 0.52 | 0.52 | 0.52 |
| Chivacure 1176 | 1.50 | 1.50 | 1.50 |
| Nanocryl XP 21/0940 | 5.15 | | |
| Nanocryl XP 21/0930 | | 5.15 | |
| Nanocryl XP 21/0954 | | | 5.15 |

Example 4

In a further example, the concentrations of two epoxy components (Nanopox XP 22/0314 and Nanopox 22/0516 (bisphenol A diglycidyl ether), each available from Hanse Chemie) having nano-sized silica particulate filler are varied.

In addition, an oxetane component, OXT-212 (3-ethyl-3-(2-ethylhexyloxymethyl)oxetane), is included. A polyol (Terathane 250) and a photocatalyst (Chivacure 1176) are included. The compositions are illustrated in Table 4.

TABLE 4

Example Backsize Formulations

| INGREDIENT | 4.1 Wt % | 4.2 Wt % | 4.3 Wt % | 4.4 Wt % |
|---|---|---|---|---|
| Nanopox XP 22/0314 | 67.89 | 58.19 | 48.50 | 38.80 |
| Nanopox XP 22/0516 | 9.70 | 19.40 | 29.10 | 38.80 |
| Terathane 250 | 9.70 | 9.70 | 9.70 | 9.70 |
| OXT-212 | 9.70 | 9.70 | 9.70 | 9.70 |
| Chivacure 1176 | 2.91 | 2.91 | 2.91 | 2.91 |

Example 5

In another example, a coating formulation has the composition illustrated in Table 5. The coating formulation includes both nano-sized filler particles supplied through the addition of Nanopox A 610 and micron-sized fillers (NP-30 and ATH S-3) having an approximate average particle size of 3 microns. NP-30 includes spherical silica particles having an average particle size of about 3 micron. ATH S-3 includes non-spherical alumina anhydride particles having an average particle size of about 3 microns. The sample has a Young's modulus of 8.9 GPa (1300 ksi), a tensile strength of 77.2 MPa (11.2 ksi), and an elongation at break of 1%.

TABLE 5

Example Backsize Formulation

| INGREDIENT | Wt. % |
|---|---|
| UVR-6105 | 0.71 |
| Heloxy 67 | 6.50 |
| SR-351 | 2.91 |
| DPHA | 1.80 |
| (3-glycidoxypropyl) trimethoxysilane | 1.17 |
| Chivacure 184 | 0.78 |
| NP-30 | 46.71 |
| ATH S-3 | 7.78 |
| Nanopox A 610 | 27.75 |
| Chivacure 1176 | 3.89 |
| SDA 5688 | 0.00072 |

Example 6

Samples are formed using a UV curable epoxy/acrylate backsize formulation coated on Mylar film (see Table 6). The coating is partially cured, embossed, and then fully cured. The embossed patterns include 25$^{th}$ random trihelical, 50$^{th}$ random trihelical, 25$^{th}$ trihelical, 50$^{th}$ trihelical, 75$^{th}$ trihelical, 45$^{th}$ pyramid, and 16$^{th}$ quad. Also, a sample is prepared without an embossed pattern.

A make coating, abrasive grains, and size coating are applied to the opposite side of Mylar film. The abrasive grains are 80 micron heat-treated semi-friable aluminum oxide BFRPL, P180 grit (Treibacher Industries, Inc.). Both make coat and size coating are UV-curable epoxy/acrylate resins. The abrasive grains and make coat overlie the backing on the opposite side of the Mylar film to that having the backsize friction coating.

A comparative sample is formed using Mylar film with the make coat, abrasive grains, and size coating. The comparative sample has a backsize coat formed from a water-based emulsion with silica filler. The backsize coat is first oven dried to remove the water. As a result, portions of the silica filler generally protrude from the surface of the backsize coat, creating a friction surface on the backing. The backsize coat is subsequently photocured.

TABLE 6

Backsize Formulation

| INGREDIENT | Wt. % |
|---|---|
| Nanopox A 610 | 40.39 |
| Terathane 250 | 12.12 |
| Chivacure 184 | 0.40 |
| Chivacure 1176 | 1.21 |
| Nanocryl A 223 | 8.08 |
| Nanopox A 510 | 20.19 |
| Modaflow 2100 | 0.41 |
| BYK A-501 | 0.02 |
| Silwet L 7600 | 0.17 |
| TRMO 813 Minsil 40 | 16.60 |
| Silane A174 | 0.41 |

The friction coefficient is measured via a Falex test method. A sample is attached to a sample holder using a quartz wax and weighed. A carbon steel test ball is mounted to a ball holder, inspected, cleaned with alcohol, and weighed. The mounted sample and mounted test ball are inserted into the Falex device. The applied load is set to 1.5 Lb. The test ball is rotated at 50 rpm on the test backing specimens under different media conditions (dry, mineral oil or water soluble coolant) for five minutes. The tangential force is collected every 2 seconds. The friction coefficient is calculated based on tangential force and other parameters.

TABLE 7

Friction Behavior of Embossed Backsize Formulations

| Sample | Embossing pattern | Friction Coefficient Dry | Mineral Oil | Water soluble coolant |
|---|---|---|---|---|
| Comparative Sample | | 0.19 | 0.16 | 0.24 |
| 6.1 | 25$^{th}$ Random Trihelical | 0.67 | 0.09 | 0.14 |
| 6.2 | 50$^{th}$ Random Trihelical | 0.64 | 0.08 | 0.13 |
| 6.3 | 45$^{th}$ Pyramid | 0.69 | 0.10 | 0.11 |
| 6.4 | 16$^{th}$ Quad | 0.64 | 0.11 | 0.23 |

As illustrated in Table 7, the samples exhibit a lower coefficient of friction when lubricated with mineral oil or water soluble coolant.

TABLE 8

Friction Behavior of Embossed Backsize Formulations

| Sample | Embossing Pattern | Friction Coefficient Dry | Mineral Oil | Water soluble coolant |
|---|---|---|---|---|
| 6.5 | 25$^{th}$ Trihelical | 0.70 | 0.45 | 0.27 |
| 6.6 | 50$^{th}$ Trihelical | 0.43 | 0.28 | 0.22 |
| 6.7 | 75$^{th}$ Trihelical | 0.45 | 0.19 | 0.23 |

As illustrated in Table 8, samples having large features tend to exhibit a higher coefficient of friction, while the effect of further size reduction is reduced for smaller features. In particular, sample 6.5, which includes 25 rows per inch, has a higher coefficient of friction than samples 6.6 and 6.7, which have 50 and 75 rows per inch, respectively.

The samples are further tested for stock removal and finishing. An abrasive tape having dimensions 1 inch by 30 inches is placed in a microfinisher test apparatus. A 1.983 inch diameter workpiece ring formed of 1045 steel is inserted into the apparatus. During testing the workpiece rotates about its central axis in both directions and also oscillates back and forth along the central axis. Mineral seal oil is applied to the workpiece as a coolant. A shoe formed of segmented India stone supplied by IMPCO provides back support to the abrasive tape. The microfinisher settings include the driver motor key set at 1.25, the number of revolutions set at 14, the oscillation motor key set at 2.5 and the pressure set at 75 psi. These conditions provide a cycle time of approximately 5 seconds at 210 RPM and a 5 HZ oscillation.

Prior to testing the workpiece rings are washed using a non-abrasive cleaner and are air-dried. An initial measurement of the ring and ring surface is taken. The weight of the ring is measured using a Toledo PB 303 scale. The surface quality is measured using a Taylor-Hobson Surtronic 3+. The rings are mounted into the apparatus and the abrasive tape is inserted. The rings are ground for 5 seconds in each direction and are then washed and measured.

TABLE 9

Relative Abrading Performance

| Test | Sample | Comparative Sample |
|---|---|---|
| Stock Removal (average value relative to comparative sample) | 1.29 | 1.0 |
| Rz (average value relative to comparative sample) | 0.93 | 1.0 |

As illustrated in Table 9, the sample including the backsize coat surprisingly exhibits improved stock removal and lower Rz than the comparative sample.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes may be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciated that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive article comprising:

a backing having first and second major surfaces;

an abrasive layer overlying the first major surface;

a backsize layer overlying the second major surface, the backsize layer formed from a cured formulation including a cationically polymerizable component, a radically polymerizable component, and greater than 5% by weight of a nano-sized filler based on the weight of the formulation, the nano-sized filler having an average particle size of not greater than 100 nm and being substantially monodispersed;

wherein the backsize layer is configured with protrusions extending at least about 10 microns in the normal direction to the second major surface of the backing;

wherein the protrusions have a pyramidal shape, a prism shape, or a combination thereof, and wherein the protrusions with a prism shape are ordered in closely arranged rows with 20 to 80 rows per 25.4 mm (1 inch), or the protrusions with a pyramidal shape are sized and arranged to include 10 to 60 pyramids per 25.4 mm (1 inch).

2. The abrasive article of claim 1, wherein the formulation includes about 10.0 wt % to about 90.0 wt % of the cationically polymerizable component.

3. The abrasive article of claim 1, wherein the formulation includes not greater than about 40.0 wt % of the radically polymerizable component.

4. The abrasive article of claim 1, wherein the radically polymerizable component includes an acrylic component.

5. The abrasive article of claim 1, wherein the abrasive layer includes abrasive grains.

6. The abrasive article of claim 1, wherein the nano-sized filler has an average particle size of about 3 nm to about 100 nm.

7. The abrasive article of claim 1, wherein the formulation includes greater than 5.0 wt % and not greater than 50.0 wt % of the nano-sized filler.

8. The abrasive article of claim 1, wherein the nano-sized filler is a solution formed inorganic particulate.

9. The abrasive article of claim 1, wherein the nano-sized filler includes silica.

10. The abrasive article of claim 1, wherein the backing includes a polymer film.

11. The abrasive article of claim 10, wherein the polymer film is formed of a thermoplastic polymer.

12. The abrasive article of claim 1, wherein the cured formulation has an elongation-at-break of at least about 1.0%.

13. The abrasive article of claim 1, wherein the cured formulation has a tensile strength of at least about 20 MPa.

14. The abrasive article of claim 1, wherein the cured formulation has a Young's modulus of at least about 500 MPa.

15. The abrasive article of claim 1, wherein the backsize layer is formed from a solution having a nanocomposite polymer precursor.

16. The abrasive article of claim 15, wherein the abrasive layer includes abrasive grains.

17. The abrasive article of claim 15, wherein the solution formed nanocomposite polymer precursor includes a solution formed filler.

18. The abrasive article of claim 17, wherein the solution formed filler has an average particle size of about 3 nm to about 100 nm.

19. A method of forming an abrasive article, the method comprising:

coating a first major surface of a backing with a binder formulation;

coating a second major surface of the backing with a backsize formulation, the backsize formulation including a cationically polymerizable component, a radically polymerizable component, and at least 5% by weight of a nano-sized filler based on the weight of the backsize formulation, the nano-sized filler having an average particle size of not greater than 100 nm and being substantially monodispersed;

curing the binder formulation and the backsize formulation; and forming a set of protrusions in the backsize formulation coated on the second major surface of the backing prior to curing the binder formulation and the backsize formulation, wherein forming the set of protrusions includes forming protrusions extending at least about 10 microns in the normal direction to the second major surface of the backing, wherein the protrusions have a pyramidal shape, a prism shape, or a combination thereof, and wherein the protrusions with a prism shape are ordered in closely arranged row with 20 to 80 rows per 25.4 mm (1 inch), or the protrusions with a pyramidal shape are sized and arranged to include 10 to 60 pyramids per 25.4 mm (1 inch).

20. The method of claim 19, wherein curing the binder formulation and the backsize formulation includes curing the binder formulation and the backsize formulation concurrently.

* * * * *